US010837181B2

(12) United States Patent
Josefsson et al.

(10) Patent No.: US 10,837,181 B2
(45) Date of Patent: Nov. 17, 2020

(54) METHOD FOR PRODUCING A MECHANICAL LOCKING SYSTEM FOR PANELS

(71) Applicant: VÄLINGE INNOVATION AB, Viken (SE)

(72) Inventors: Per Josefsson, Ramlosa (SE); Christian Boo, Kagerod (SE)

(73) Assignee: VALINGE INNOVATION AB, Viken (SE)

( * ) Notice: Subject to any disclaimer, the term of this patent is extended or adjusted under 35 U.S.C. 154(b) by 266 days.

(21) Appl. No.: 15/379,957

(22) Filed: Dec. 15, 2016

(65) Prior Publication Data

US 2017/0175400 A1 Jun. 22, 2017

(30) Foreign Application Priority Data

Dec. 17, 2015 (SE) ..... 1551670

(51) Int. Cl.
*E04F 15/02* (2006.01)
*E04F 15/10* (2006.01)
*E04F 13/08* (2006.01)

(52) U.S. Cl.
CPC .... *E04F 15/02038* (2013.01); *E04F 13/0894* (2013.01); *E04F 15/02005* (2013.01);
(Continued)

(58) Field of Classification Search
CPC ..... E04F 15/02011; E04F 15/02038; E04F 13/0894; E04F 15/102
(Continued)

(56) References Cited

U.S. PATENT DOCUMENTS 1,787,027 A 12/1930 Wasleff
3,120,083 A 2/1964 Dahlberg et al.
(Continued)

FOREIGN PATENT DOCUMENTS

CA 2 252 791 A1 5/1999
CN 1270263 A 10/2000
(Continued)

OTHER PUBLICATIONS

Machine Translation of DE202004021867 (Year: 2011).*
(Continued)

*Primary Examiner* — Jacob J Cigna
*Assistant Examiner* — Michael W Hotchkiss
(74) *Attorney, Agent, or Firm* — Buchanan Ingersoll & Rooney P.C.

(57) ABSTRACT

A method for producing a mechanical locking system for a first panel and a second panel. The method includes providing a tongue, including a first locking surface, at a first edge of the first panel, forming a tongue groove, including a second locking surface, at a second edge of the second panel, the first locking surface and second locking surface are configured to cooperate for locking the first edge to the second edge in a first direction, providing a first guiding surface at the first edge and a second guiding surface at the second edge, wherein the first guiding surface cooperates with the second guiding surface during an assembling of the first edge and the second edge, and working of the first guiding surface and/or the second guiding surface to reduce the coefficient of friction between the first guiding surface and the second guiding surface and/or a surface roughness.

21 Claims, 7 Drawing Sheets

(52) U.S. Cl.
CPC ..... *E04F 15/102* (2013.01); *E04F 15/105* (2013.01); *E04F 2201/0138* (2013.01); *E04F 2201/0146* (2013.01); *E04F 2201/023* (2013.01); *E04F 2201/042* (2013.01); *E04F 2201/043* (2013.01); *E04F 2201/0535* (2013.01); *E04F 2201/0547* (2013.01); *E04F 2201/0588* (2013.01)

(58) Field of Classification Search
USPC ..... 29/897.32
See application file for complete search history.

(56) References Cited

U.S. PATENT DOCUMENTS 3,247,638 A 4/1966 Gay et al.
3,538,665 A 11/1970 Gohner
3,694,983 A 10/1972 Couquet
3,720,027 A 3/1973 Christensen
3,742,669 A 7/1973 Mansfeld
3,760,547 A 9/1973 Brenneman
3,857,749 A 12/1974 Yoshida
3,919,820 A 11/1975 Green
4,113,399 A 9/1978 Hansen, Sr. et al.
4,172,169 A 10/1979 Mawson et al.
4,176,210 A 11/1979 Skinner
4,180,615 A 12/1979 Bettoli
4,187,131 A 2/1980 Shortway et al.
4,196,554 A 4/1980 Anderson et al.
4,313,866 A 2/1982 Renshaw
4,333,987 A 6/1982 Kwart et al.
4,393,187 A 7/1983 Boba et al.
4,423,178 A 12/1983 Renshaw
4,426,820 A * 1/1984 Terbrack ..... E01C 13/107 52/590.1
4,489,115 A 12/1984 Layman et al.
4,507,188 A 3/1985 Chu
4,512,131 A 4/1985 Laramore
4,599,841 A 7/1986 Haid
4,614,680 A 9/1986 Fry et al.
4,772,500 A 9/1988 Stroppiana
4,785,065 A 11/1988 Uhl et al.
4,807,412 A 2/1989 Frederiksen
5,007,222 A 4/1991 Raymond
5,112,671 A 5/1992 Diamond et al.
5,148,850 A 9/1992 Urbanick
5,162,141 A 11/1992 Davey et al.
5,182,892 A 2/1993 Chase
5,344,700 A 9/1994 McGath et al.
5,380,794 A 1/1995 Schaefer et al.
5,441,677 A * 8/1995 Phillips, Sr. ..... E04F 15/14 264/31
5,458,953 A 10/1995 Wang et al.
5,465,546 A 11/1995 Buse
5,548,937 A 8/1996 Shimonohara
5,618,602 A 4/1997 Nelson
5,630,304 A 5/1997 Austin
5,670,237 A 9/1997 Shultz et al.
5,694,730 A 12/1997 Del Rincon et al.
5,797,237 A 8/1998 Finkell, Jr.
5,950,389 A 9/1999 Porter
6,006,486 A 12/1999 Moriau et al.
6,052,960 A 4/2000 Yonemura
6,065,262 A 5/2000 Motta
6,101,778 A 8/2000 Martensson
6,139,945 A 10/2000 Krejchi et al.
6,173,548 B1 1/2001 Hamar et al.
6,182,410 B1 2/2001 Pervan
6,209,278 B1 4/2001 Tychsen
6,216,409 B1 4/2001 Roy et al.
6,233,899 B1 5/2001 Mellert et al.
6,291,078 B1 9/2001 Chen et al.
6,324,809 B1 12/2001 Nelson
6,332,733 B1 12/2001 Hamberger et al.
6,345,481 B1 2/2002 Nelson
6,363,677 B1 4/2002 Chen
6,455,127 B1 9/2002 Valtanen
6,490,836 B1 12/2002 Moriau et al.
6,505,452 B1 1/2003 Hannig
6,536,178 B1 3/2003 Palsson et al.
6,546,691 B2 4/2003 Leopolder
6,553,724 B1 4/2003 Bigler
6,558,070 B1 5/2003 Valtanen
6,617,009 B1 9/2003 Chen et al.
6,647,690 B1 11/2003 Martensson
6,672,030 B2 1/2004 Schulte
6,675,545 B2 1/2004 Chen et al.
6,729,091 B1 5/2004 Martensson
6,761,008 B2 7/2004 Chen et al.
6,763,643 B1 7/2004 Martensson
6,766,622 B1 7/2004 Theirs
6,769,218 B2 8/2004 Pervan
6,769,219 B2 8/2004 Schwitte et al.
6,772,568 B2 8/2004 Thiers
6,790,512 B2 9/2004 MacQueen et al.
6,804,926 B1 10/2004 Eisermann
6,851,241 B2 2/2005 Pervan
6,854,235 B2 2/2005 Martensson
6,862,857 B2 3/2005 Tychsen
6,865,855 B2 3/2005 Knauseder
6,874,292 B2 4/2005 Moriau
6,880,307 B2 4/2005 Schwitte
6,895,881 B1 5/2005 Whitaker
6,928,779 B2 8/2005 Moriau et al.
6,986,934 B2 1/2006 Chen et al.
7,051,486 B2 5/2006 Pervan
7,090,430 B1 8/2006 Fletcher
7,121,058 B2 10/2006 Palsson et al.
7,155,871 B1 1/2007 Stone et al.
7,169,460 B1 1/2007 Chen et al.
7,171,791 B2 2/2007 Pervan
7,211,310 B2 5/2007 Chen et al.
7,251,916 B2 8/2007 Konzelmann et al.
7,275,350 B2 10/2007 Pervan et al.
7,337,588 B1 3/2008 Moebus
7,377,081 B2 5/2008 Ruhdorfer
7,398,625 B2 7/2008 Pervan
7,419,717 B2 9/2008 Chen et al.
7,451,578 B2 11/2008 Hannig
7,454,875 B2 * 11/2008 Pervan ..... E04F 15/02 52/586.2
7,484,337 B2 2/2009 Hecht
7,552,568 B2 6/2009 Palsson et al.
7,568,322 B2 8/2009 Pervan et al.
7,584,583 B2 9/2009 Bergelin et al.
7,603,826 B1 10/2009 Moebus
7,607,271 B2 10/2009 Griffin et al.
7,614,197 B2 11/2009 Nelson
7,617,645 B2 11/2009 Moriau et al.
7,621,094 B2 11/2009 Moriau et al.
7,634,886 B2 12/2009 Moriau et al.
7,634,887 B2 12/2009 Moriau et al.
7,637,066 B2 12/2009 Moriau et al.
7,640,708 B2 1/2010 Moriau et al.
7,644,555 B2 1/2010 Moriau et al.
7,644,557 B2 1/2010 Moriau et al.
7,647,743 B2 1/2010 Moriau et al.
7,650,728 B2 1/2010 Moriau et al.
7,654,054 B2 2/2010 Moriau et al.
7,658,048 B2 2/2010 Moriau et al.
7,677,001 B2 3/2010 Pervan
7,678,215 B2 3/2010 Martin
7,716,896 B2 5/2010 Pervan
7,739,849 B2 6/2010 Pervan
7,763,345 B2 7/2010 Chen et al.
7,779,597 B2 8/2010 Thiers et al.
7,802,415 B2 9/2010 Pervan
7,841,144 B2 * 11/2010 Pervan ..... E04F 15/02 52/395
7,841,150 B2 11/2010 Pervan
7,856,784 B2 12/2010 Martensson
7,856,789 B2 12/2010 Eisermann
7,861,482 B2 1/2011 Pervan

(56) References Cited

U.S. PATENT DOCUMENTS 7,866,110 B2 * 1/2011 Pervan ..... E04F 15/18 52/586.2
7,886,497 B2 2/2011 Pervan et al.
7,896,571 B1 3/2011 Hannig et al.
7,930,862 B2 4/2011 Bergelin et al.
7,958,689 B2 6/2011 Lei
7,980,043 B2 7/2011 Moebus
7,984,600 B2 7/2011 Alford et al.
8,006,460 B2 8/2011 Chen et al.
8,021,741 B2 9/2011 Chen et al.
8,028,486 B2 * 10/2011 Pervan ..... E04F 15/04 428/50
8,038,363 B2 10/2011 Hannig
8,042,311 B2 10/2011 Pervan et al.
8,071,193 B2 12/2011 Windmoller
8,091,238 B2 1/2012 Hannig et al.
8,099,924 B2 1/2012 Braun
8,112,891 B2 2/2012 Pervan
8,132,384 B2 3/2012 Hannig
8,166,718 B2 5/2012 Liu
8,191,333 B2 6/2012 Braun
8,196,366 B2 6/2012 Thiers
8,215,078 B2 * 7/2012 Pervan ..... B27N 7/00 428/192
8,234,829 B2 8/2012 Thiers et al.
8,245,478 B2 8/2012 Bergelin et al.
8,281,549 B2 10/2012 Du
8,293,058 B2 10/2012 Pervan et al.
8,353,140 B2 1/2013 Pervan et al.
8,356,452 B2 1/2013 Thiers et al.
8,365,499 B2 2/2013 Nilsson et al.
8,375,672 B2 2/2013 Hannig
8,375,674 B2 2/2013 Braun
8,480,841 B2 7/2013 Pervan et al.
8,484,924 B2 7/2013 Braun
8,490,361 B2 7/2013 Curry et al.
8,499,521 B2 8/2013 Pervan et al.
8,511,031 B2 8/2013 Bergelin et al.
8,544,231 B2 10/2013 Hannig
8,544,232 B2 10/2013 Wybo et al.
8,544,234 B2 10/2013 Pervan et al.
8,584,423 B2 11/2013 Pervan et al.
8,613,826 B2 12/2013 Pervan et al.
8,658,274 B2 2/2014 Chen et al.
8,707,651 B2 4/2014 Stockl
8,720,149 B2 5/2014 Bossuyt
8,726,604 B2 5/2014 Hannig
8,745,952 B2 6/2014 Perra et al.
8,756,899 B2 6/2014 Nilsson et al.
8,763,340 B2 7/2014 Pervan et al.
8,800,150 B2 8/2014 Pervan
8,806,832 B2 8/2014 Kell
8,833,028 B2 9/2014 Whispell et al.
8,834,992 B2 9/2014 Chen et al.
8,952,078 B2 2/2015 Gould
8,966,853 B2 3/2015 Hannig
8,978,336 B2 3/2015 Perra
9,103,126 B2 8/2015 Kell
9,212,492 B2 12/2015 Pervan et al.
9,217,250 B2 12/2015 Perra
9,222,267 B2 12/2015 Bergelin et al.
9,228,360 B2 1/2016 Schneider
9,249,581 B2 2/2016 Nilsson et al.
9,260,870 B2 2/2016 Vermeulen et al.
9,296,191 B2 3/2016 Pervan et al.
9,314,936 B2 4/2016 Pervan
9,371,653 B2 6/2016 Liu
9,410,328 B2 8/2016 Pervan
9,528,278 B2 12/2016 Cappelle
9,650,792 B2 5/2017 Ramachandra
9,695,600 B2 7/2017 Vandervoorde
9,695,601 B2 7/2017 Whispell et al.
9,695,851 B2 7/2017 Hannig
9,714,515 B2 7/2017 Pervan
9,745,758 B2 * 8/2017 Baert ..... E04F 15/105
9,765,530 B2 9/2017 Bergelin et al.
9,777,487 B2 10/2017 Pervan et al.
9,803,374 B2 * 10/2017 Pervan ..... E04F 15/02038
9,816,270 B2 * 11/2017 Pervan ..... E04B 5/02
9,874,035 B2 1/2018 Wagner
9,885,186 B2 2/2018 Liu
9,885,187 B2 2/2018 Kell
10,000,935 B2 6/2018 Kell
10,047,527 B2 8/2018 Nilsson et al.
10,059,084 B2 8/2018 Lundblad et al.
10,113,318 B2 * 10/2018 Cappelle ..... B65D 85/62
10,137,659 B2 11/2018 Pervan
10,214,917 B2 2/2019 Pervan et al.
10,287,777 B2 5/2019 Boo et al.
10,301,830 B2 5/2019 Boo
10,316,526 B2 6/2019 Kell
10,344,379 B2 7/2019 Pervan
10,407,919 B2 9/2019 Boo
10,450,760 B2 10/2019 Bergelin et al.
10,486,399 B2 11/2019 Chen et al.
10,493,731 B2 12/2019 Lundblad et al.
10,526,793 B2 1/2020 Nilsson et al.
10,704,269 B2 7/2020 Whispell et al.
2001/0021431 A1 9/2001 Chen
2002/0007606 A1 1/2002 Kettler
2002/0007608 A1 1/2002 Pervan
2002/0007609 A1 1/2002 Pervan
2002/0031646 A1 3/2002 Chen
2002/0069611 A1 6/2002 Leopolder
2002/0092263 A1 7/2002 Schulte
2002/0142135 A1 10/2002 Chen et al.
2002/0152707 A1 10/2002 Martensson
2002/0170258 A1 11/2002 Schwitte et al.
2002/0178674 A1 12/2002 Pervan
2002/0178681 A1 12/2002 Zancai
2002/0189183 A1 12/2002 Ricciardelli
2003/0009971 A1 1/2003 Palmberg
2003/0024199 A1 2/2003 Pervan
2003/0024200 A1 2/2003 Moriau et al.
2003/0037504 A1 2/2003 Schwitte et al.
2003/0041545 A1 3/2003 Stanchfield
2003/0101674 A1 6/2003 Pervan et al.
2003/0101681 A1 6/2003 Tychsen
2003/0110720 A1 6/2003 Berard et al.
2003/0180091 A1 9/2003 Stridsman
2003/0188504 A1 10/2003 Eisermann
2003/0196405 A1 10/2003 Pervan
2003/0224147 A1 12/2003 Maine et al.
2004/0031225 A1 2/2004 Fowler
2004/0031227 A1 2/2004 Knauseder
2004/0060255 A1 4/2004 Knauseder
2004/0068954 A1 4/2004 Martensson
2004/0128934 A1 7/2004 Hecht
2004/0137180 A1 7/2004 Sjoberg et al.
2004/0139678 A1 7/2004 Pervan
2004/0177584 A1 9/2004 Pervan
2004/0182036 A1 9/2004 Sjoberg et al.
2004/0206036 A1 * 10/2004 Pervan ..... E04F 15/02194 52/578
2004/0211143 A1 10/2004 Hanning
2004/0211144 A1 10/2004 Stanchfield
2004/0219339 A1 11/2004 Dempsey et al.
2004/0241374 A1 12/2004 Thiers
2004/0255538 A1 12/2004 Ruhdorfer
2004/0255541 A1 12/2004 Thiers et al.
2004/0261348 A1 12/2004 Vulin
2005/0003160 A1 1/2005 Chen et al.
2005/0028474 A1 2/2005 Kim
2005/0112320 A1 5/2005 Wright
2005/0138881 A1 6/2005 Pervan
2005/0144881 A1 7/2005 Tate et al.
2005/0166514 A1 8/2005 Pervan
2005/0176321 A1 8/2005 Crette et al.
2005/0193677 A1 9/2005 Vogel
2005/0208255 A1 9/2005 Pervan
2005/0210810 A1 9/2005 Pervan
2005/0221073 A1 10/2005 Liou
2005/0235593 A1 10/2005 Hecht
2005/0247000 A1 11/2005 Zhu

(56) References Cited

U.S. PATENT DOCUMENTS

2005/0250921 A1 11/2005 Qiu et al.
2005/0252130 A1 11/2005 Martensson
2005/0268570 A2 12/2005 Pervan
2006/0010820 A1* 1/2006 Schwitte ..... E04F 13/0826 52/592.1
2006/0032168 A1 2/2006 Thiers et al.
2006/0032175 A1 2/2006 Chen et al.
2006/0053724 A1 3/2006 Braun et al.
2006/0070333 A1 4/2006 Pervan
2006/0101769 A1 5/2006 Pervan et al.
2006/0154015 A1 7/2006 Miller et al.
2006/0156666 A1 7/2006 Caufield
2006/0174974 A1 8/2006 Brannstrom et al.
2006/0225377 A1 10/2006 Moriau et al.
2006/0236642 A1 10/2006 Pervan
2006/0248830 A1 11/2006 Moriau et al.
2006/0248831 A1 11/2006 Moriau et al.
2006/0260252 A1 11/2006 Brice
2006/0260254 A1 11/2006 Pervan
2007/0006543 A1 1/2007 Engstrom
2007/0011981 A1 1/2007 Eiserman
2007/0022694 A1 2/2007 Chen et al.
2007/0028547 A1 2/2007 Grafenauer et al.
2007/0094986 A1 5/2007 Moriau et al.
2007/0094987 A1 5/2007 Moriau et al.
2007/0130872 A1 6/2007 Goodwin
2007/0151189 A1 7/2007 Yang
2007/0151191 A1 7/2007 August
2007/0154840 A1 7/2007 Thies et al.
2007/0175148 A1* 8/2007 Bergelin ..... E04F 15/02161 52/480
2007/0175156 A1 8/2007 Pervan et al.
2007/0184230 A1 8/2007 Verrue et al.
2007/0193178 A1 8/2007 Groeke et al.
2007/0196624 A1 8/2007 Chen et al.
2007/0218252 A1 9/2007 Donald
2007/0275207 A1 11/2007 Higgins et al.
2008/0000182 A1 1/2008 Pervan
2008/0000183 A1 1/2008 Bergelin et al.
2008/0000186 A1 1/2008 Pervan et al.
2008/0000188 A1 1/2008 Pervan
2008/0010931 A1 1/2008 Pervan et al.
2008/0010937 A1 1/2008 Pervan
2008/0028707 A1 2/2008 Pervan
2008/0028713 A1 2/2008 Pervan
2008/0029490 A1 2/2008 Martin et al.
2008/0034701 A1 2/2008 Pervan
2008/0034708 A1 2/2008 Pervan
2008/0041007 A1 2/2008 Pervan
2008/0053028 A1 3/2008 Moriau et al.
2008/0060309 A1 3/2008 Moriau et al.
2008/0060310 A1 3/2008 Moriau et al.
2008/0092473 A1 4/2008 Heyns
2008/0104921 A1 5/2008 Pervan et al.
2008/0110125 A1 5/2008 Pervan
2008/0133560 A1 6/2008 Windmoller
2008/0134607 A1 6/2008 Pervan
2008/0134613 A1 6/2008 Pervan
2008/0134614 A1 6/2008 Pervan
2008/0138560 A1 6/2008 Windmoller
2008/0141610 A1 6/2008 Thiers
2008/0148674 A1 6/2008 Thiers et al.
2008/0153609 A1 6/2008 Kotler
2008/0172971 A1 7/2008 Pervan
2008/0184646 A1 8/2008 Alford
2008/0241440 A1 10/2008 Bauer
2008/0256890 A1 10/2008 Pervan
2008/0311355 A1 12/2008 Chen et al.
2009/0031662 A1 2/2009 Chen et al.
2009/0038253 A1 2/2009 Martensson
2009/0049787 A1 2/2009 Hannig
2009/0110888 A1 4/2009 Wuest et al.
2009/0133353 A1 5/2009 Pervan et al.
2009/0151290 A1* 6/2009 Liu ..... E04F 15/04 52/586.1
2009/0159156 A1 6/2009 Walker
2009/0186710 A1 7/2009 Joseph
2009/0193748 A1 8/2009 Boo
2009/0217611 A1 9/2009 Schrader
2009/0223162 A1 9/2009 Chen et al.
2009/0226662 A1 9/2009 Dyczko-Riglin et al.
2009/0235604 A1 9/2009 Cheng et al.
2009/0249733 A1 10/2009 Moebus
2009/0260313 A1 10/2009 Segaert
2009/0272058 A1 11/2009 Duselis et al.
2009/0320402 A1 12/2009 Schacht et al.
2010/0011695 A1 1/2010 Cheng
2010/0018149 A1 1/2010 Thiers
2010/0031594 A1 2/2010 Liu
2010/0043333 A1 2/2010 Hannig et al.
2010/0058702 A1 3/2010 Lei
2010/0260962 A1 10/2010 Chen et al.
2010/0293879 A1 11/2010 Pervan et al.
2010/0300029 A1 12/2010 Braun et al.
2010/0319293 A1 12/2010 Dammers et al.
2011/0001420 A1 1/2011 Tchakarov et al.
2011/0008567 A1 1/2011 Weeks et al.
2011/0030303 A1 2/2011 Pervan et al.
2011/0041996 A1 2/2011 Pervan
2011/0056167 A1 3/2011 Nilsson et al.
2011/0094178 A1 4/2011 Braun
2011/0131901 A1 6/2011 Pervan et al.
2011/0131909 A1 6/2011 Hannig
2011/0138722 A1* 6/2011 Hannig ..... E04F 15/02 52/309.1
2011/0146177 A1 6/2011 Hannig
2011/0154763 A1 6/2011 Bergelin et al.
2011/0167744 A1* 7/2011 Whispell ..... E04F 15/02 52/309.1
2011/0173914 A1 7/2011 Engstrom
2011/0247285 A1 10/2011 Wybo
2011/0247748 A1 10/2011 Pervan et al.
2011/0258959 A1 10/2011 Braun
2011/0296780 A1 12/2011 Windmoller
2012/0003439 A1 1/2012 Chen et al.
2012/0017534 A1 1/2012 Oh
2012/0040149 A1 2/2012 Chen et al.
2012/0066996 A1 3/2012 Konstanczak
2012/0067461 A1 3/2012 Braun
2012/0124932 A1 5/2012 Schulte et al.
2012/0137617 A1 6/2012 Pervan
2012/0174519 A1 7/2012 Schulte
2012/0174521 A1 7/2012 Schulte
2012/0180416 A1 7/2012 Perra et al.
2012/0192521 A1 8/2012 Schulte
2012/0216472 A1 8/2012 Martensson
2012/0266555 A1 10/2012 Cappelle
2012/0276369 A1 11/2012 Jing et al.
2012/0279154 A1 11/2012 Bergelin et al.
2012/0304581 A1 12/2012 Kim
2013/0008118 A1* 1/2013 Baert ..... B29C 63/044 52/588.1
2013/0014890 A1 1/2013 Pervan et al.
2013/0025964 A1* 1/2013 Ramachandra ..... C08L 91/06 181/284
2013/0042563 A1 2/2013 Pervan et al.
2013/0042565 A1 2/2013 Pervan et al.
2013/0047536 A1 2/2013 Pervan
2013/0097959 A1 4/2013 Michel
2013/0111758 A1 5/2013 Nilsson et al.
2013/0152492 A1 6/2013 Whitaker
2013/0160391 A1 6/2013 Pervan et al.
2013/0174507 A1 7/2013 Oehrlein
2013/0212971 A1 8/2013 Cordeiro
2013/0243996 A1 9/2013 Hannig
2013/0269863 A1 10/2013 Pervan et al.
2013/0283719 A1* 10/2013 Dohring ..... E04F 13/0894 52/582.2
2013/0298487 A1 11/2013 Bergelin et al.
2013/0305650 A1 11/2013 Liu
2013/0309441 A1 11/2013 Hannig
2013/0333182 A1 12/2013 Pervan et al.
2014/0007539 A1 1/2014 Pervan et al.

(56) References Cited

U.S. PATENT DOCUMENTS

| | | | | |
|---|---|---|---|---|
| 2014/0033633 | A1* | 2/2014 | Kell | E04F 15/02033 52/588.1 |
| 2014/0033635 | A1 | 2/2014 | Pervan et al. | |
| 2014/0069043 | A1 | 3/2014 | Pervan | |
| 2014/0069044 | A1 | 3/2014 | Wallin | |
| 2014/0115994 | A1 | 5/2014 | Pervan | |
| 2014/0186104 | A1 | 7/2014 | Hamberger | |
| 2014/0215946 | A1 | 8/2014 | Roy et al. | |
| 2014/0237924 | A1 | 8/2014 | Nilsson et al. | |
| 2014/0283466 | A1 | 9/2014 | Boo | |
| 2014/0283477 | A1 | 9/2014 | Hannig | |
| 2014/0290173 | A1* | 10/2014 | Hamberger | E04F 13/0894 52/582.2 |
| 2014/0318061 | A1 | 10/2014 | Pervan | |
| 2014/0325930 | A1 | 11/2014 | Schneider | |
| 2014/0352248 | A1 | 12/2014 | Whispell et al. | |
| 2014/0356594 | A1 | 12/2014 | Chen et al. | |
| 2014/0366476 | A1 | 12/2014 | Pervan | |
| 2014/0366477 | A1 | 12/2014 | Kell | |
| 2015/0114552 | A1* | 4/2015 | Cernohous | C08J 5/00 156/242 |
| 2015/0225964 | A1 | 8/2015 | Chen et al. | |
| 2015/0252573 | A1 | 9/2015 | Devos | |
| 2015/0330088 | A1 | 11/2015 | Derelöv | |
| 2015/0368910 | A1 | 12/2015 | Kell | |
| 2016/0016390 | A1 | 1/2016 | Lundblad et al. | |
| 2016/0016391 | A1 | 1/2016 | Lundblad et al. | |
| 2016/0047129 | A1 | 2/2016 | Bowers | |
| 2016/0052245 | A1 | 2/2016 | Chen et al. | |
| 2016/0069089 | A1 | 3/2016 | Bergelin et al. | |
| 2016/0076260 | A1 | 3/2016 | Pervan et al. | |
| 2016/0108624 | A1 | 4/2016 | Nilsson et al. | |
| 2016/0115695 | A1 | 4/2016 | Devos | |
| 2016/0138274 | A1 | 5/2016 | Anspach et al. | |
| 2016/0186318 | A1 | 6/2016 | Pervan et al. | |
| 2016/0194883 | A1 | 7/2016 | Pervan | |
| 2016/0194885 | A1 | 7/2016 | Whispell et al. | |
| 2016/0201324 | A1 | 7/2016 | Håkansson et al. | |
| 2016/0265234 | A1 | 9/2016 | Pervan | |
| 2016/0333595 | A1 | 11/2016 | Cappelle | |
| 2016/0375674 | A1 | 12/2016 | Schulte | |
| 2017/0030088 | A1 | 2/2017 | Simoens | |
| 2017/0037642 | A1 | 2/2017 | Boo | |
| 2017/0037645 | A1 | 2/2017 | Pervan | |
| 2017/0241136 | A1 | 8/2017 | Kell | |
| 2017/0350140 | A1 | 12/2017 | Bergelin et al. | |
| 2017/0362834 | A1 | 12/2017 | Pervan et al. | |
| 2017/0370109 | A1 | 12/2017 | Devos | |
| 2018/0010342 | A1 | 1/2018 | Van Hooydonck | |
| 2018/0094441 | A1 | 4/2018 | Boo et al. | |
| 2018/0313093 | A1 | 11/2018 | Nilsson et al. | |
| 2019/0017278 | A1 | 1/2019 | De Rick et al. | |
| 2019/0091977 | A1 | 3/2019 | Lundblad et al. | |
| 2019/0136545 | A1 | 5/2019 | De Rick et al. | |
| 2019/0211569 | A1 | 7/2019 | Boo et al. | |
| 2019/0249444 | A1 | 8/2019 | Kell | |
| 2019/0277041 | A1 | 9/2019 | Pervan et al. | |
| 2019/0394314 | A1 | 12/2019 | Pervan et al. | |
| 2020/0056379 | A1 | 2/2020 | Boo | |
| 2020/0063441 | A1 | 2/2020 | Boo | |
| 2020/0180282 | A1 | 6/2020 | Lundblad et al. | |
| 2020/0208409 | A1 | 7/2020 | Kell | |

FOREIGN PATENT DOCUMENTS

| | | | | |
|---|---|---|---|---|
| CN | 101492950 | | 7/2009 | |
| DE | 2 251 762 | | 5/1974 | |
| DE | 198 54 475 | A1 | 7/1999 | |
| DE | 202 07 844 | U | 8/2002 | |
| DE | 20 2005 004 537 | U1 | 6/2005 | |
| DE | 198 54 475 | B4 | 6/2006 | |
| DE | 10 2005 061 099 | A1 | 3/2007 | |
| DE | 10 2006 024 184 | A1 | 11/2007 | |
| DE | 10 2006 058 655 | A1 | 6/2008 | |
| DE | 10 2006 058 655 | B4 | 6/2008 | |
| DE | 20 2008 011 589 | U1 | 11/2008 | |
| DE | 20 2008 012 001 | U1 | 11/2008 | |
| DE | 20 2004 021 867 | U1 | 12/2011 | |
| DE | 202004021867 | U1 * | 12/2011 | E04F 15/02 |
| DE | 20 2016 102 034 | U1 | 5/2016 | |
| EP | 1 045 083 | A1 | 10/2000 | |
| EP | 1 165 906 | | 1/2002 | |
| EP | 1 165 906 | B1 | 8/2002 | |
| EP | 1 045 083 | B1 | 10/2002 | |
| EP | 1 308 577 | A2 | 5/2003 | |
| EP | 1 350 904 | A2 | 10/2003 | |
| EP | 1 420 125 | A2 | 5/2004 | |
| EP | 1 585 875 | | 10/2005 | |
| EP | 1 585 875 | B1 | 10/2006 | |
| EP | 1 570 143 | | 5/2007 | |
| EP | 1 938 963 | A1 | 7/2008 | |
| EP | 2 009 197 | A1 | 12/2008 | |
| EP | 2 339 092 | A1 | 6/2011 | |
| EP | 2 516 768 | | 6/2011 | |
| EP | 2 615 221 | A1 | 7/2013 | |
| FR | 1 293 043 | | 4/1961 | |
| GB | 1 430 423 | A | 3/1976 | |
| JP | 60-255843 | A | 12/1985 | |
| JP | 7-180333 | A | 7/1995 | |
| JP | H07-300979 | | 11/1995 | |
| JP | H08-74405 | A | 3/1996 | |
| JP | 3363976 | B2 | 1/2003 | |
| KR | 1996-0005785 | | 7/1996 | |
| KR | 10-2008-0096189 | | 10/2008 | |
| KR | 10-0870496 | | 11/2008 | |
| SE | 0000785 | A | 9/2001 | |
| WO | WO 94/26999 | A1 | 11/1994 | |
| WO | WO 96/27721 | A1 | 9/1996 | |
| WO | WO 98/58142 | A1 | 12/1998 | |
| WO | WO 00/47841 | A1 | 8/2000 | |
| WO | WO 00/66856 | A1 | 11/2000 | |
| WO | WO 01/02669 | A1 | 1/2001 | |
| WO | WO 01/02670 | A1 | 1/2001 | |
| WO | WO 01/02671 | A1 | 1/2001 | |
| WO | WO 01/44669 | A2 | 6/2001 | |
| WO | WO 01/44669 | A3 | 6/2001 | |
| WO | WO 01/48331 | A1 | 7/2001 | |
| WO | WO 01/48332 | A1 | 7/2001 | |
| WO | WO 01/51732 | A1 | 7/2001 | |
| WO | WO 01/51733 | A1 | 7/2001 | |
| WO | WO 01/66877 | A1 | 9/2001 | |
| WO | WO 01/75247 | A1 | 10/2001 | |
| WO | WO 01/77461 | A1 | 10/2001 | |
| WO | WO 01/88306 | A1 | 11/2001 | |
| WO | WO 01/98604 | A1 | 12/2001 | |
| WO | WO 02/103135 | A1 | 12/2002 | |
| WO | WO 03/012224 | A1 | 2/2003 | |
| WO | WO 03/016654 | A1 | 2/2003 | |
| WO | WO 03/044303 | A1 | 5/2003 | |
| WO | WO 2004/011740 | A2 | 2/2004 | |
| WO | WO 2004/016877 | A1 | 2/2004 | |
| WO | WO 2004/050780 | A2 | 6/2004 | |
| WO | WO 2004/085765 | A1 | 10/2004 | |
| WO | WO 2005/068747 | A1 | 7/2005 | |
| WO | WO 2005/088029 | A1 | 9/2005 | |
| WO | WO 2005/098163 | A1 | 10/2005 | |
| WO | WO 2006/032378 | A1 | 3/2006 | |
| WO | WO 2006/043893 | A1 | 4/2006 | |
| WO | WO-2006104436 | A1 * | 10/2006 | F16B 5/0016 |
| WO | WO 2006/123988 | A1 | 11/2006 | |
| WO | WO 2006/133690 | A1 | 12/2006 | |
| WO | WO 2007/015669 | A2 | 2/2007 | |
| WO | WO 2007/015669 | A3 | 2/2007 | |
| WO | WO 2007/016978 | A1 | 2/2007 | |
| WO | WO 2007/020088 | A1 | 2/2007 | |
| WO | WO 2007/079845 | A1 | 7/2007 | |
| WO | WO 2007/118352 | A1 | 10/2007 | |
| WO | WO 2008/008016 | A1 | 1/2008 | |
| WO | WO 2008/008824 | A1 | 1/2008 | |
| WO | WO 2008/068245 | A1 | 6/2008 | |
| WO | WO 2008/116623 | A1 | 10/2008 | |
| WO | WO 2008/133377 | A1 | 11/2008 | |
| WO | WO 2009/061279 | A1 | 5/2009 | |

(56) References Cited

FOREIGN PATENT DOCUMENTS

| | | | | |
|---|---|---|---|---|
| WO | WO 2009/071822 | A2 | 6/2009 | |
| WO | WO 2009/071822 | A3 | 6/2009 | |
| WO | WO 2010/015516 | A2 | 2/2010 | |
| WO | WO 2010/015516 | A3 | 2/2010 | |
| WO | WO 2010/023042 | A1 | 3/2010 | |
| WO | WO 2010/028901 | A1 | 3/2010 | |
| WO | WO 2010/072357 | A2 | 7/2010 | |
| WO | WO 2010/072357 | A3 | 7/2010 | |
| WO | WO 2010/081532 | A1 | 7/2010 | |
| WO | WO 2010/086084 | A1 | 8/2010 | |
| WO | WO 2010/114236 | A2 | 10/2010 | |
| WO | WO 2010/128043 | A1 | 11/2010 | |
| WO | WO 2011/012104 | A2 | 2/2011 | |
| WO | WO 2011/028171 | A1 | 3/2011 | |
| WO | WO 2011/032540 | A2 | 3/2011 | |
| WO | WO 2011/038709 | A1 | 4/2011 | |
| WO | WO 2011/077311 | A2 | 6/2011 | |
| WO | WO 2012/084604 | A1 | 6/2012 | |
| WO | WO 2012/101171 | A1 | 8/2012 | |
| WO | WO 2012/126046 | A1 | 9/2012 | |
| WO | WO 2012/136021 | A1 | 10/2012 | |
| WO | WO 2013/017575 | A1 | 2/2013 | |
| WO | WO 2013/026559 | A2 | 2/2013 | |
| WO | WO 2013/044758 | A1 | 4/2013 | |
| WO | WO 2013/092270 | A1 | 6/2013 | |
| WO | WO 2013/151493 | A1 | 10/2013 | |
| WO | WO 2014/007738 | A1 | 1/2014 | |
| WO | WO 2014/043756 | A1 | 3/2014 | |
| WO | WO 2014/182215 | A1 | 11/2014 | |
| WO | WO 2014/209213 | A1 | 12/2014 | |
| WO | WO 2015/078443 | A1 | 6/2015 | |
| WO | WO 2015/104680 | A1 | 7/2015 | |
| WO | WO 2015/174914 | A1 | 11/2015 | |
| WO | WO 2016/029255 | A1 | 3/2016 | |
| WO | WO-2017101910 | A1 * | 6/2017 | ..... E04F 15/02038 |
| WO | WO 2017/115202 | A1 | 7/2017 | |
| WO | WO 2017/187298 | A2 | 11/2017 | |

OTHER PUBLICATIONS

Machine Translation of DE202004021867 (Year: 2012).*
Machine Translation of WO2017101910 (Year: 2016).*
Lowe's, How to Install a Laminate Floor, YouTube video available for viewing at https://youtu.be/zhIXVHAejlk?t=3m52s, Oct. 2008 (last accessed Feb. 15, 2018).
U.S. Appl. No. 14/224,628, Christian Boo, filed Mar. 25, 2014. (Cited herein as US Patent Application Publication No. 2014/0283466 A1 of Sep. 25, 2014).
U.S. Appl. No. 14/463,008, John M. Whispell, filed Aug. 19, 2014 (Cited herein as US Patent Application Publication No. 2014/0352248 A1 of Dec. 4, 2014).
U.S. Appl. No. 14/982,608, Mats Nilsson, filed Dec. 29, 2015 (Cited herein as US Patent Application Publication No. 2016/0108624 A1 of Apr. 21, 2016).
U.S. Appl. No. 15/067,999, Darko Pervan, filed Mar. 11, 2016 (Cited herein as US Patent Application Publication No. 2016/0194883 A1 of Jul. 7, 2016).
U.S. Appl. No. 15/072,829, John M. Whispell, filed Mar. 17, 2016 (Cited herein as US Patent Application Publication No. 2016/0194885 A1 of Jul. 7, 2016).
U.S. Appl. No. 15/333,630, Christian Boo, filed Oct. 15, 2016 (Cited herein as US Patent Application Publication No. 2017/0037642 A1 of Feb. 9, 2017).
U.S. Appl. No. 15/404,617, Christian Boo, filed Jan. 12, 2017.
U.S. Appl. No. 15/404,617, Boo.
Pervan, Darko (Author)/Valinge Innovation, Technical Disclosure entitled "VA073a Zip Loc," Sep. 13, 2011, IP.com No. IPCOM0002108690, IP.com PriorArtDatabase, 36 pages.
Boo, Christian, U.S. Appl. No. 15/404,617 entitled "Set of Panels," filed in the U.S. Patent and Trademark Office on Jan. 12, 2017.
U.S. Appl. No. 15/507,602, Richard William Kell, filed Feb. 28, 2017 (Cited herein as US Patent Application Publication No. 2017/0241136 A1 of Aug. 24, 2017).
U.S. Appl. No. 16/027,465, Mats Nilsson and Per Nygren, filed Jul. 5, 2018 (Cited herein as US Patent Application Publication No. 2018/0313093 A1 of Nov. 1, 2018).
International Search Report and Written Opinion issued in PCT/SE2016/051272, dated Feb. 1, 2017, Patent-och registreringsverket, Stockholm, SE, 12 pages.
U.S. Appl. No. 16/220,748, Christian Boo, Marcus Nilsson Ståhl and Anders Nilsson, filed Dec. 14, 2018.
U.S. Appl. No. 16/220,748, Boo, et al.
Boo, Christian, et al., U.S. Appl. No. 16/220,748, entitled "Set of Panels," filed in the U.S. Patent and Trademark Office on Dec. 14, 2018.
U.S. Appl. No. 16/366,173, Boo.
U.S. Appl. No. 16/392,931, Kell.
Boo, Christian, U.S. Appl. No. 16/366,173 entitled "Set of Panels," filed in the U.S. Patent and Trademark Office on Mar. 27, 2019.
Kell, Richard William, U.S. Appl. No. 16/392,931, entitled "Vertical Joint System for a Surface Covering Panel," filed in the U.S. Patent and Trademark Office on Apr. 24, 2019.
U.S. Appl. No. 16/528,992, Christian Boo, filed Aug. 1, 2019.
U.S. Appl. No. 16/528,992, Boo.
Extended European Search Report dated Jul. 1, 2019 in EP 16876159.1, European Patent Office, Munich, DE, 10 pages.
Boo, Christian, U.S. Appl. No. 16/528,992 entitled "*Floorboards Provided with a Mechanical Locking System," filed in the U.S. Patent and Trademark Office on Aug. 1, 2019.
U.S. Appl. No. 16/699,297, Richard William Kell, filed Nov. 29, 2019.
U.S. Appl. No. 16/713,431, Mats Nilsson and Per Nygren, filed Dec. 13, 2019.
U.S. Appl. No. 16/699,297, Kell.
U.S. Appl. No. 16/713,431, Nilsson et al.
Kell, Richard William, U.S. Appl. No. 16/699,297 entitled "Vertical Joint System for a Surface Covering Panel," filed in the U.S. Patent and Trademark Office on Nov. 29, 2019.
Nilsson, Mats, et al., U.S. Appl. No. 16/713,431 entitled "Resilient Floor," filed in the U.S. Patent and Trademark Office on Dec. 13, 2019.
U.S. Appl. No. 16/887,559, John M Whispell and Hao A Chen, filed May 29, 2020.
U.S. Appl. No. 16/887,559, Whispell et al.
Whispell, John M., et al., U.S. Appl. No. 16/887,559 entitled "Floor Covering with Interlocking Design," filed in the U.S. Patent and Trademark Office on May 29, 2020.

* cited by examiner

METHOD FOR PRODUCING A MECHANICAL LOCKING SYSTEM FOR PANELS

CROSS REFERENCE TO RELATED APPLICATIONS

The present application claims the benefit of Swedish application no. 1551670-1, filed on 17 Dec. 2015. The entire contents of Swedish application no. 1551670-1 are hereby expressly incorporated by reference in their entirety.

TECHNICAL FIELD

The present disclosure relates to floorboards provided with a mechanical locking system, and a method for producing a mechanical locking system at edges of floorboards.

BACKGROUND

Panels provided with a mechanical locking device are known in the art, as evidenced by WO2014/182215 (A1). The panels are, for some materials, difficult to assemble.

SUMMARY

One object of certain embodiments of the present invention to provide an improvement over the above described technique and the known art. A specific objective of certain embodiments is to improve assembling of panels, such as floor, building or furniture panels.

At least some of these and other objects and advantages that will be apparent from the description have been achieved by embodiments of a first aspect of the invention that includes a method for producing a mechanical locking system for a first panel and a second panel, such as building panels or floor panels, wherein the method comprises:

- providing a tongue, comprising a first locking surface, at a first edge of the first panel;
- forming a tongue groove, comprising a second locking surface, preferably by mechanical cutting, at a second edge of the second panel, said first locking surface and second locking surface are configured to cooperate for locking the first edge to the second edge in a first direction;
- providing a first guiding surface at the first edge and a second guiding surface at the second edge, wherein the mechanical locking system is configured such that first guiding surface cooperates with the second guiding surface during an assembling of the first edge and the second edge; and
- working of the first guiding surface and/or the second guiding surface to reduce a coefficient of friction and/or to reduce a surface roughness.

The mechanical locking system may be produced by mechanical cutting, such as milling, preferably in a milling line. Said working of the first guiding surface and/or the second guiding surface to reduce the coefficient of friction and/or surface roughness may be made in the milling line. The mechanical cutting may result in a guiding surface with a high friction coefficient and/or a coarse surface roughness. An assembling of the first panel and the second panel that comprise guiding surfaces with a high friction coefficient or a coarse surface roughness may be difficult. The assembling may be facilitated by said working of the first and/or the second guiding surface.

The method for forming the second locking surface may be different from the method for working of the second guiding surface.

The method for forming the first locking surface may be different from the method for working of the first guiding surface.

The working of the first guiding surface and/or the second guiding surface may be polishing, sanding, rolling, grinding and/or pressing by, e.g., a fixed tool, such as a sliding bar or pressure shoe. The fixed tool may be of metal, such as steel, and preferably comprises a surface of hard metal or diamond.

The working of the first guiding surface and/or the second guiding surface preferably reduces the surface roughness within the range of about 30% to about 50%, or about 30% to about 40%. Such a decrease of surface roughness may result in a considerable reduction of the coefficient of friction. This may have the effect that the assembling of first panel and the second panel changes from being difficult to easy, or for some embodiments from being impossible to easy.

The surface roughness value may be decreased from about 3 Ra to about 2 Ra. For example, the surface roughness may be decreased at least 0.5 Ra, such as at least 0.8 Ra, such as at least 1 Ra. For example, the surface roughness may be decreased to a value of less than about 2.5 Ra, such as less than 2.2 Ra, such as less than 2 Ra.

The first panel and the second panel may comprise a core material comprising a polymer material.

The polymer material may be one or more of the materials:

Vinyls, such as polyvinyl chloride and polyvinyl butyral;
Polyolefins, such as PE and PP;
Polyesters, including polyethylene terephthalate (PET);
Styrenics, such as polystyrene;
Acrylics, such as PMMA;
Co-polymers;
Polymer blends;

The core material may comprise a filler and/or a reinforcement material.

The reinforcement material may be arranged as a reinforcement layer extending essentially parallel to an upper surface of the first panel and the second panel, respectively. Said reinforcement layer may increase the friction and may therefore be arranged such that an outer edge of the reinforcement layer is preferably at a non-guiding surface, such as a bottom surface of the tongue groove.

The filler material may be one or more of wood fibre, preferably as dust, or chalk.

The reinforcement material may be one or more of calcium silicate, e.g., wollastonite, or glass fiber.

The working of the of the first guiding surface and/or the second guiding surface may be made before the forming of the tongue groove. Applying a pressure after the forming of the tongue may deform the tongue groove and/or the first edge and/or the second edge.

The method may comprise forming an insertion groove, preferably by mechanical cutting, at the first edge and arranging the tongue, preferably a displaceable tongue, in the insertion groove.

The method may comprise forming the tongue, preferably by mechanical cutting, at the first edge.

The method may comprise:

- forming a locking element at the first edge or the second edge, preferably by mechanical cutting; and
- forming a locking groove at the other of the first edge or the second edge, preferably by mechanical cutting, wherein the locking element is configured to cooperate with the locking groove for locking the first edge to the second edge in a second direction which is perpendicular to the first direction.

The tongue may be formed at the locking element or the locking groove and the tongue groove may be formed at the other of the locking element or locking groove.

One or more of the tongue, the tongue groove, the locking element and the locking groove may be formed of a core material of the first and or the second panel.

The flexible tongue may be according to a flexible tongue described and shown in any one of WO2006/043893, WO2007/015669, or preferably FIGS. 8A-8B in WO2014/209213(A1). The entire disclosure of each of which is hereby expressly incorporated by reference herein.

The set of panels may be furniture panels.

The core may be provided with a decorative layer.

A second aspect of the invention includes a set comprising a first and a second panel produced by the method described above.

BRIEF DESCRIPTION OF THE DRAWINGS

Embodiments of the present invention will by way of example be described in more detail with reference to the appended schematic drawings, in which.

DETAILED DESCRIPTION

Figure 1A:
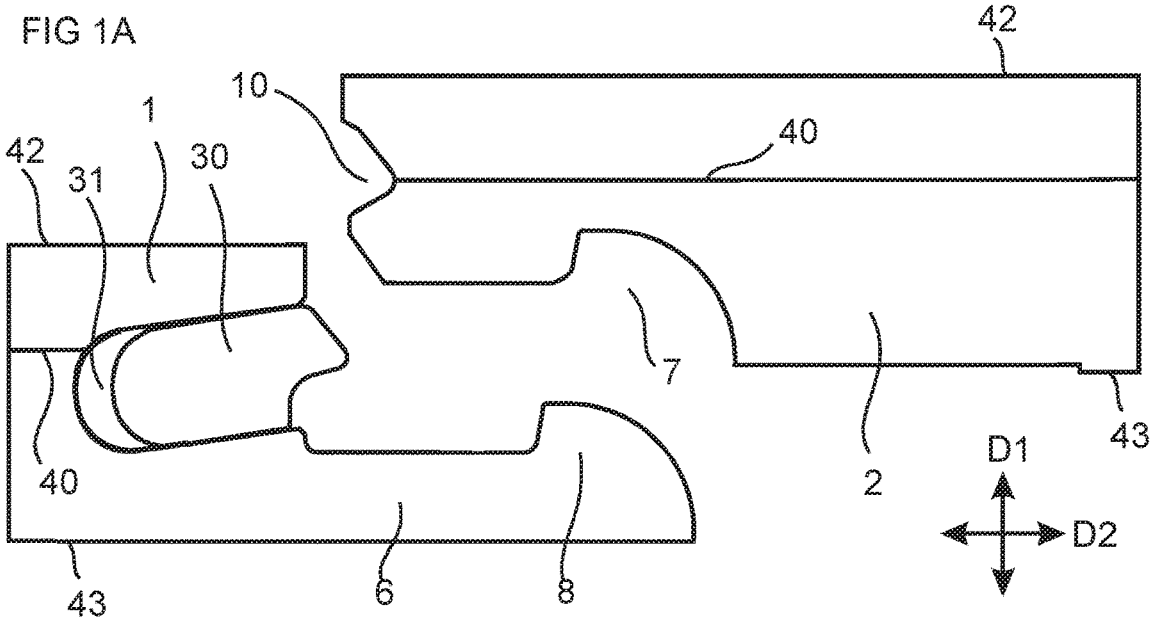
FIGS. 1A-1C show a first panel and a second panel according to an embodiment of the invention during an assembling.
Figure 1B:
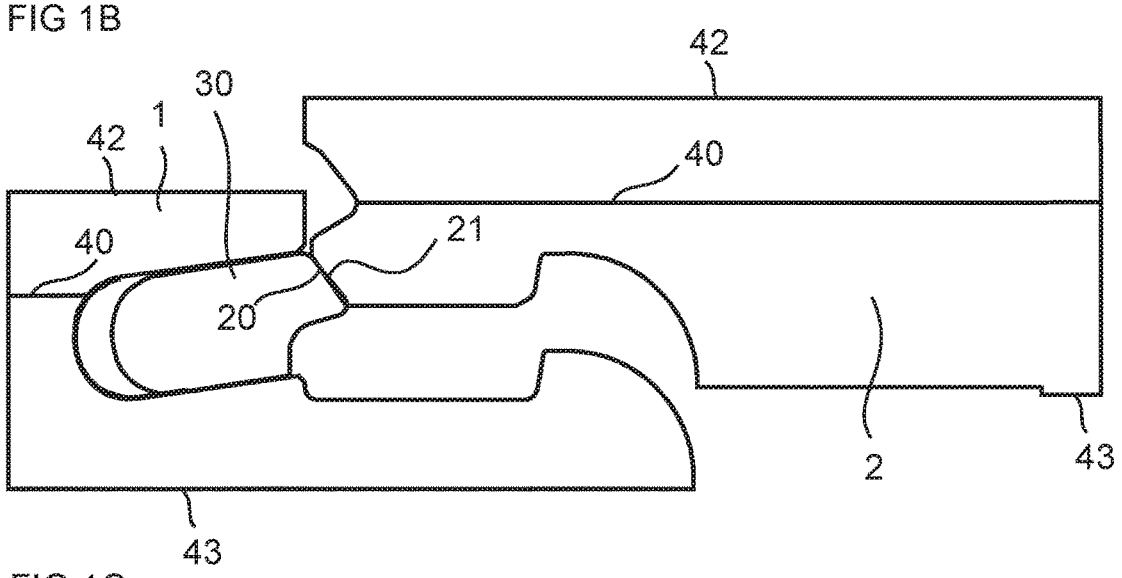
Figure 1C:
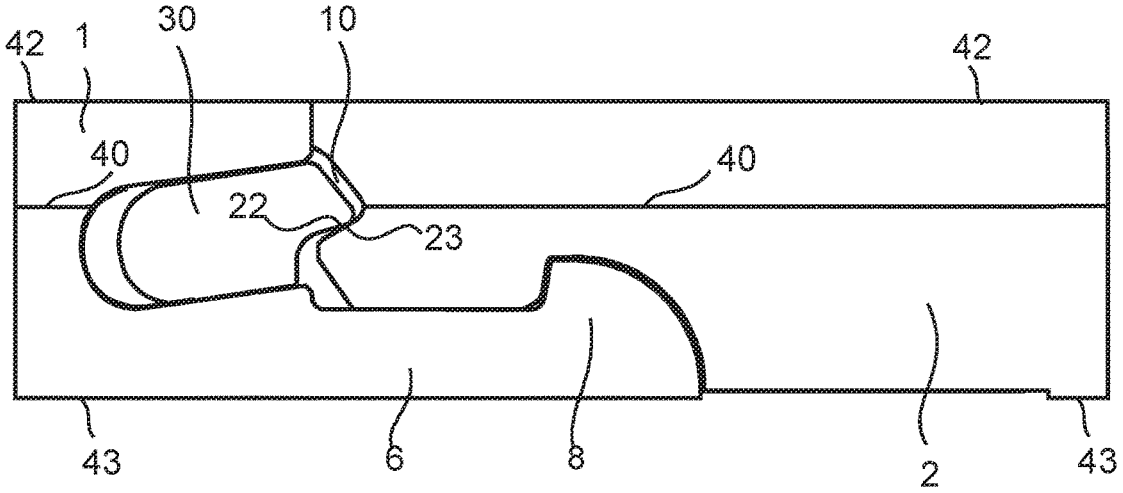

FIG. 1A-C shows an embodiment of the invention comprising an embodiment of the mechanical locking system at a first panel 1 and a second panel 2 during an assembling. A first edge of the first panel 1 comprises a tongue 30, which in this embodiment of the mechanical locking system is a flexible tongue. The tongue 30 comprises a first locking surface 22. A second edge of the second panel 2 comprises a tongue groove 10, comprising a second locking surface 23. Said first locking surface 22 and second locking surface 23 are configured to cooperate for locking the first edge to the second edge in a first direction D1, which may be in a vertical direction. The first edge comprises a first guiding surface 20 and the second edge comprises a second guiding surface 21. Said first guiding surface 20 and said second guiding surface 21 are configured such that first guiding surface 20 cooperates with the second guiding surface 21 during the assembling of the first edge and the second edge. The mechanical locking system comprises an insertion groove 31, at the first edge and a part of the flexible tongue is inserted in the insertion groove. The first guiding surface 20 is, in this embodiment, at a surface of the flexible tongue. The flexible tongue is preferably displaceable in the insertion groove 31. The mechanical locking system comprises a locking element 8 at the first edge. The locking element 8 is configured to cooperate with a locking groove 7 at the second edge for locking the first edge to the second edge in a second direction (D2), which is perpendicular to the first direction (D1). The locking element 8 is preferably arranged on a locking strip 6 protruding from the first edge and the locking groove 7 is at a lower surface 43 of the second panel. FIG. 1A shows the first panel 1 and the second panel 2 at an initial position. The first panel 1 and the second panel 2 are during the assembling displaced vertically relative each other in the first direction D1, as shown in FIG. 1B, such that the first guiding surface 20 and second guiding surface 21 cooperate with each other. The flexible tongue 30 will, in this embodiment, be displaced into insertion groove 31 and spring back to a locked position which is shown in FIG. 1C. The first locking surface 22 and the second locking surface 23 cooperate with each other in the locked position. The flexible tongue 30 may be according to a flexible tongue described and shown in any one of WO2006/043893, WO2007/015669, or preferably FIGS. 8A-8B in WO2014/209213(A1).

Figure 2A:
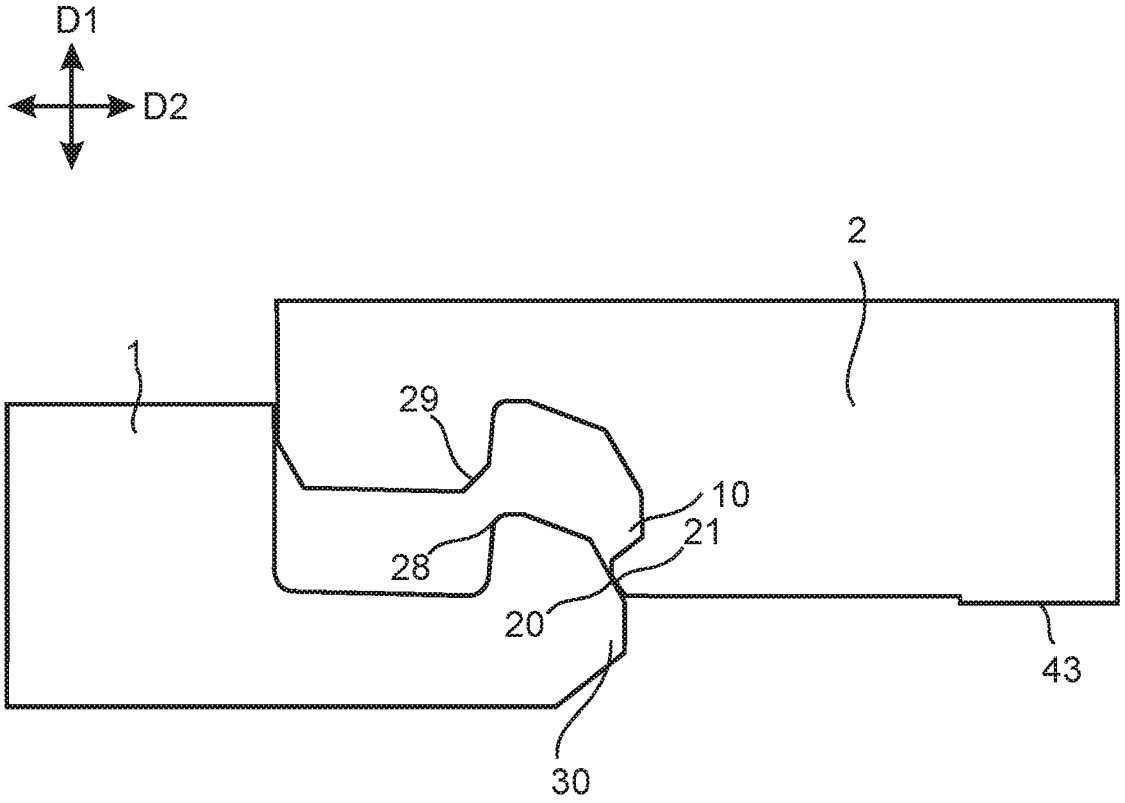
FIGS. 2A-2B show a first panel and a second panel according to an embodiment of the invention during an assembling.
Figure 2B:
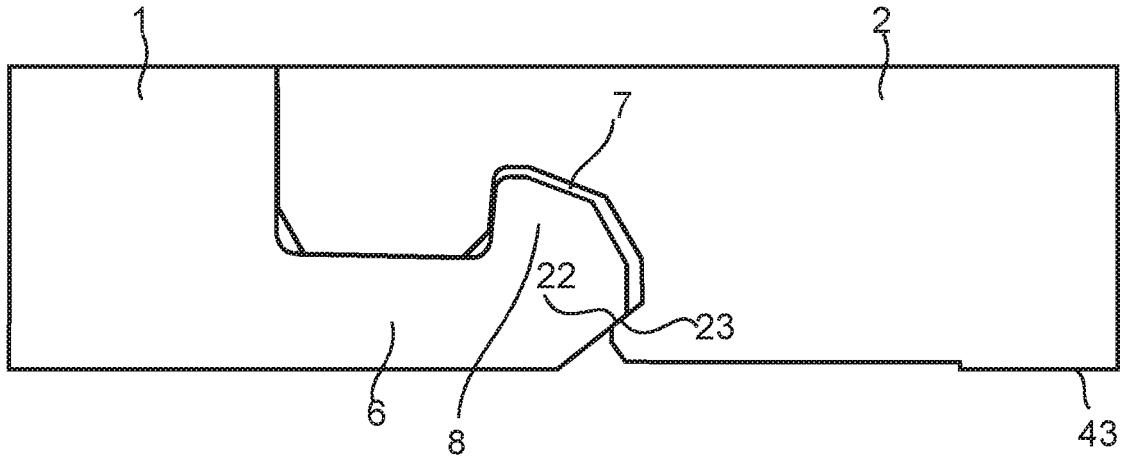

FIG. 2A-B shows an embodiment of the invention comprising another embodiment of the mechanical locking system at a first panel 1 and a second panel 2 during an assembling. The mechanical locking system comprises a locking element 8 at the first edge of the first panel 1. The locking element is configured to cooperate with a locking groove 7 at the second edge of the second panel 2 for locking the first edge to the second edge in the second direction (D2). The locking element 8 is preferably arranged on a locking strip 6 protruding from the first edge and the locking groove is at a lower surface 43 of the second panel. An outer edge of the locking strip 6 comprising a tongue 30 configured to cooperate with a tongue groove 10 at the second edge. An upper edge of the tongue 30 comprising a first guiding surface 20 and a lower surface of a lower lip of the tongue groove 10 comprises a second guiding surface 21. An upper edge of the locking element 8 may comprise a fifth guiding surface 28 and a lower a lower edge at the opening of the looking groove 7 may comprise a sixth guiding surface 29. The tongue 30 and the tongue groove 10 are preferably formed of a core material of the first panel 1 and the second panel 2, respectively. The first panel 1 and the second panel 2 are during the assembling displaced vertically relative each other in the first direction D1, as shown in FIG. 2A, such that the first guiding surface 20 and second guiding surface 21 cooperate with each other. The fifth guiding surface 28 may cooperate with the sixth guiding surface during the assembling. The first panel 1 and the second panel 2 are shown in a locked position in FIG. 2B. A first locking surface 22 of the tongue 30 and a second locking surface 23 of the tongue groove 10 cooperate with each other in the locked position.

Figure 3A:
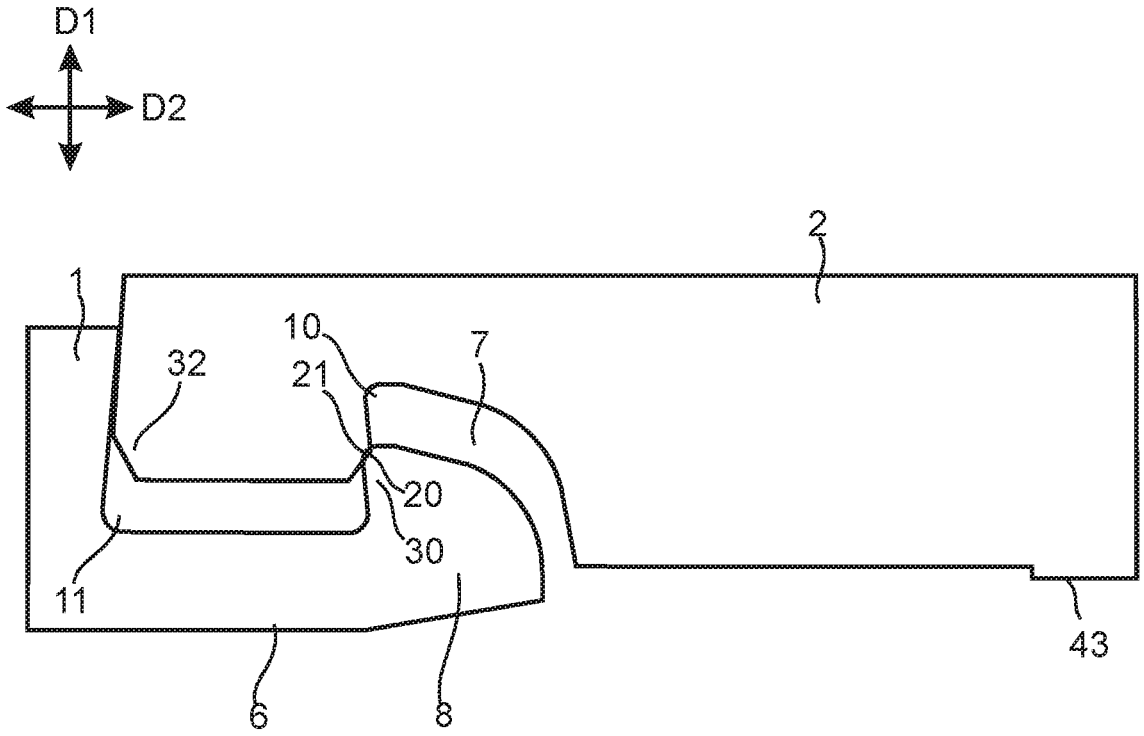
FIGS. 3A-3B show a first panel and a second panel according to an embodiment of the invention during an assembling.
Figure 3B:
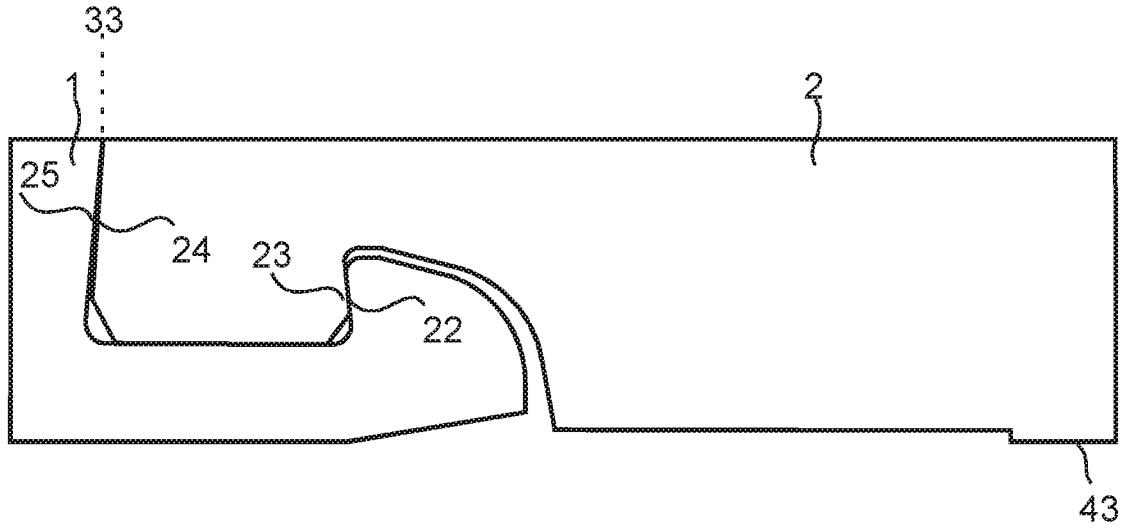

FIG. 3A-B shows an embodiment of the invention comprising another embodiment of the mechanical locking system at a first panel 1 and a second panel 2 during an assembling. The mechanical locking system comprises a locking element 8 at the first edge of the first panel 1. The locking element 8 is configured to cooperate with a locking groove 7 at the second edge of the second panel 2 for locking the first edge to the second edge in the second direction D2.

The locking element 8 is preferably arranged on a locking strip 6 protruding from the first edge and the locking groove 7 is at a lower surface 43 of the second panel. An inner edge of the locking element 8 comprising a first tongue 30 configured to cooperate with a first tongue groove 10 at an inner edge of the locking groove 7 for locking the first edge to the second edge in the first direction D1. An upper edge of the first tongue 30 at the locking element 8 comprising a first guiding surface 20 and a lower surface of a lower lip of the tongue groove at the looking groove comprises a second guiding surface 21. An upper most edge of the first panel and an upper most edge of the second panel may be in contact at a joint plane 33. The second edge comprises a second tongue 32 at the joint plane and the first edge comprises a second tongue groove 11 at the joint plane. The second tongue 31 and the second tongue groove 11 at the joint plane 33 are configured to cooperate for locking the first edge to the second edge in the first direction D1. The first tongue 30 at the locking element and the second tongue 31 at the joint plane 33, respectively, and the first tongue groove 10 at the locking groove and the second tongue groove 11 at the joint plane, respectively, are preferably formed of a core material of the first panel 1 and the second panel 2, respectively. The first panel and the second panel are, during the assembling, displaced vertically relative each other in the first direction D1, as shown in FIG. 3A, such that the first guiding surface 20 and the second guiding surface 21 cooperate with each other. The first panel and the second panel are shown in a locked position in FIG. 3B. A first locking surface 22 of the first tongue and a second locking surface 23 of the first tongue groove cooperate with each other in the locked position; a third locking surface 24 of the second tongue and a fourth locking surface 25 of the second tongue groove cooperate with each other in the locked position.

Figure 4A:
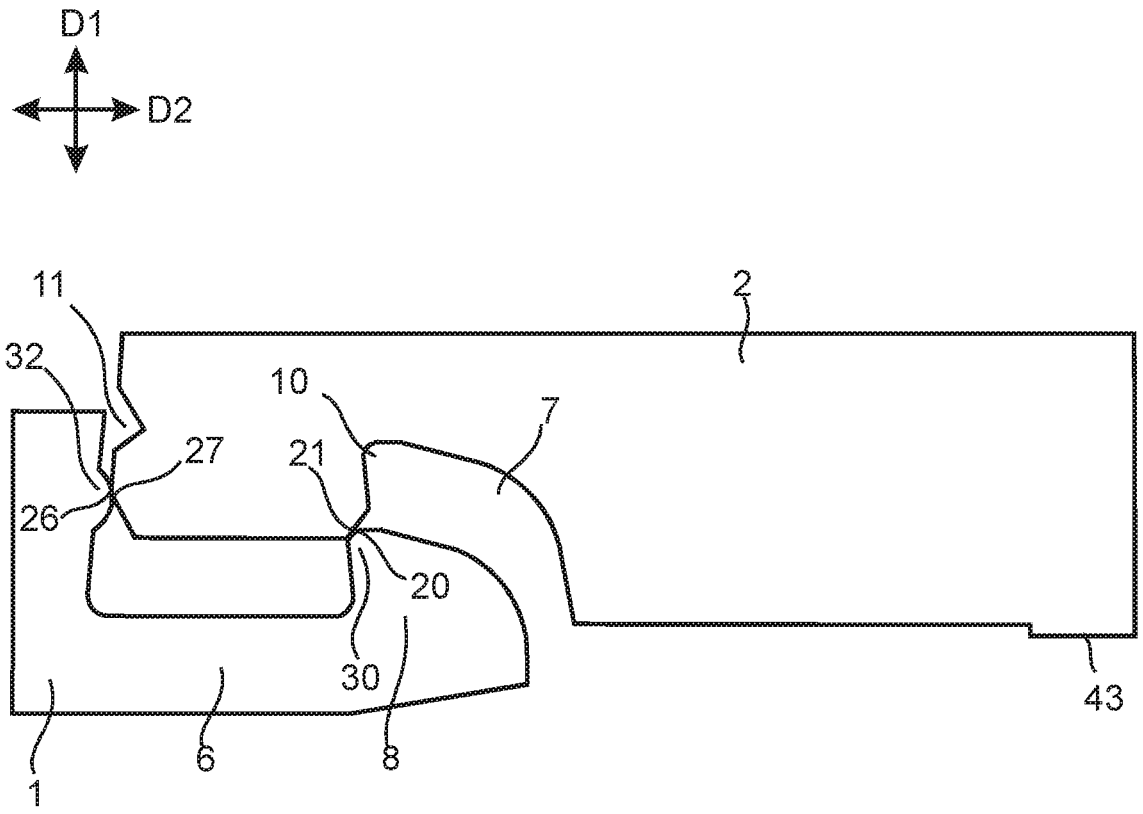
FIGS. 4A-4B show a first panel and a second panel according to an embodiment of the invention during an assembling.
Figure 4B:
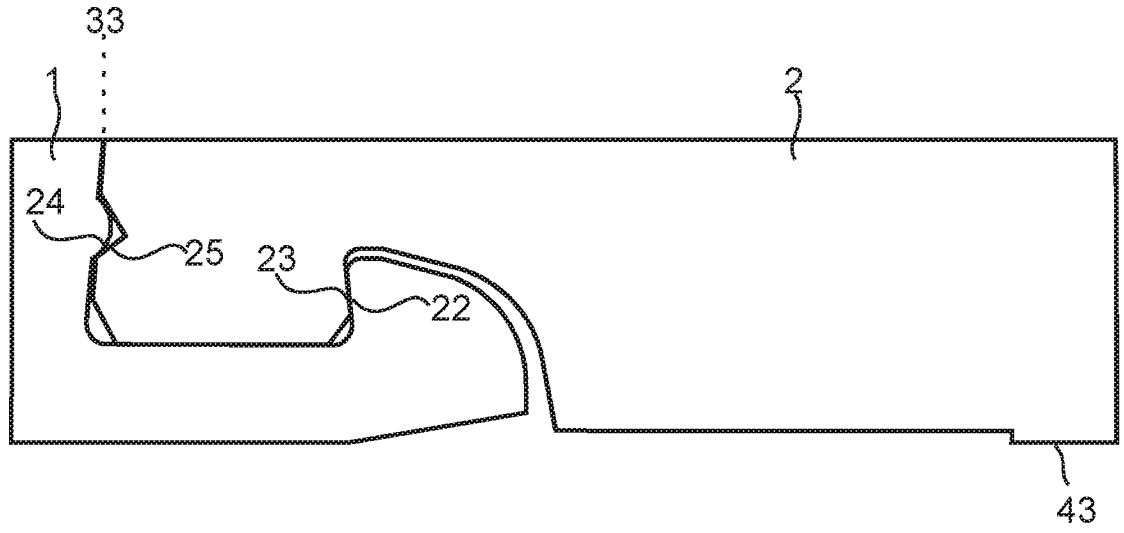

FIG. 4A-B shows an embodiment of the invention comprising another embodiment of the mechanical locking system at a first panel 1 and a second panel 2 during an assembling. The mechanical locking system comprises a locking element 8 at the first edge of the first panel 1. The locking element 8 is configured to cooperate with a locking groove 7 at the second edge of the second panel 2 for locking the first edge to the second edge in the second direction D2. The locking element 8 is preferably arranged on a locking strip 6 protruding from the first edge and the locking groove 7 is at a lower surface 43 of the second panel. An inner edge of the locking element 8 comprising a first tongue 30 configured to cooperate with a first tongue groove 10 at an inner edge of the locking groove for locking the first edge to the second edge in the first direction D1. An upper edge of the first tongue 30 at the locking element comprising a first guiding surface 20 and a lower surface of a lower lip of the first tongue groove 10 at the looking groove comprises a second guiding surface 21. An upper most edge of the first panel and an upper most edge of the second panel may be in contact at a joint plane 33. The first edge comprises a second tongue 31 at the joint plane and the second edge comprises a second tongue groove 11 at the joint plane. The second tongue 31 and the second tongue groove 11 at the joint plane are configured to cooperate for locking the first edge to the second edge in the first direction D1. An upper edge of the second tongue 31 at the joint plane comprising a third guiding surface 26 and a lower surface of a lower lip of the second tongue groove 11 at the joint plane comprises a fourth guiding surface 27. The first tongue 30 at the locking element and the second tongue 31 at the joint plane, respectively, and the first tongue groove 10 at the locking groove and the second tongue groove 11 at the joint plane, respectively, are preferably formed of a core material of the first panel 1 and the second panel 2, respectively. The first panel and the second panel are, during the assembling, displaced vertically relative each other in the first direction D1, as shown in FIG. 4A, such that the first guiding surface 20 and the second guiding surface 21 cooperate with each other, and such that the third guiding surface 26 and the fourth guiding surface 27 cooperate with each other. The first panel and the second panel are shown in a locked position in FIG. 4B. A first locking surface 22 of the first tongue 30 and a second locking surface 23 of the first tongue groove 10 cooperate with each other in the locked position; a third locking surface 24 of the second tongue and a fourth locking surface 25 of the second tongue groove cooperate with each other in the locked position.

Figure 5A:
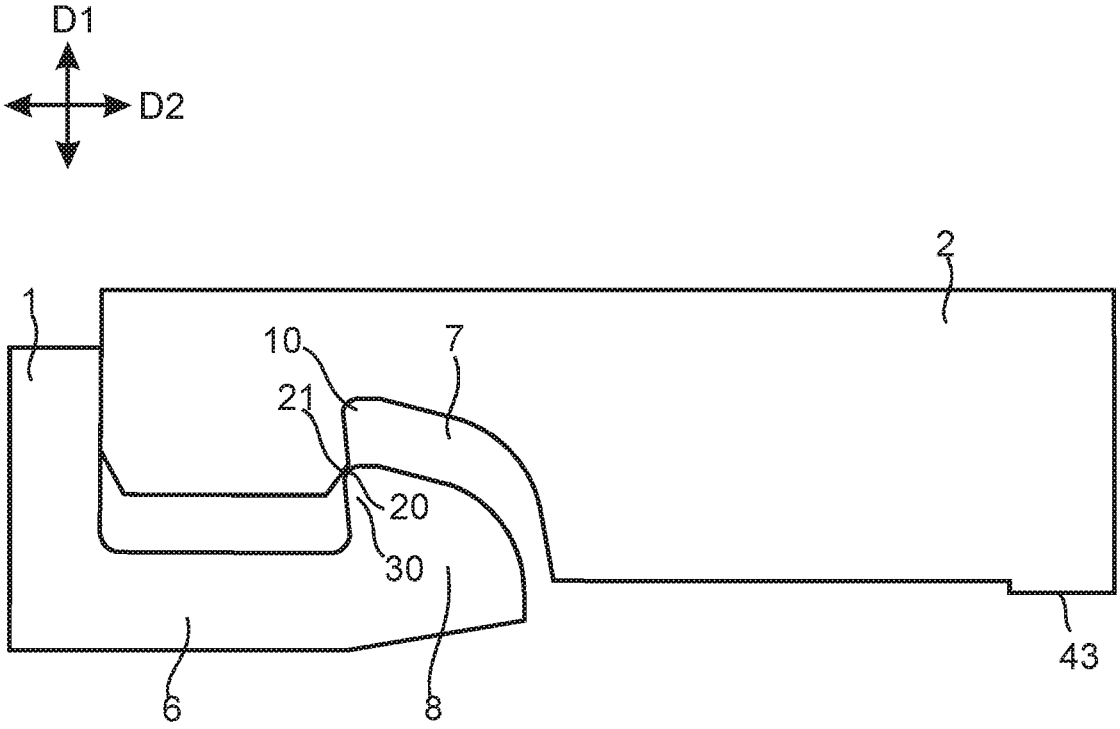
FIGS. 5A-5B show a first panel and a second panel according to an embodiment of the invention during an assembling.
Figure 5B:
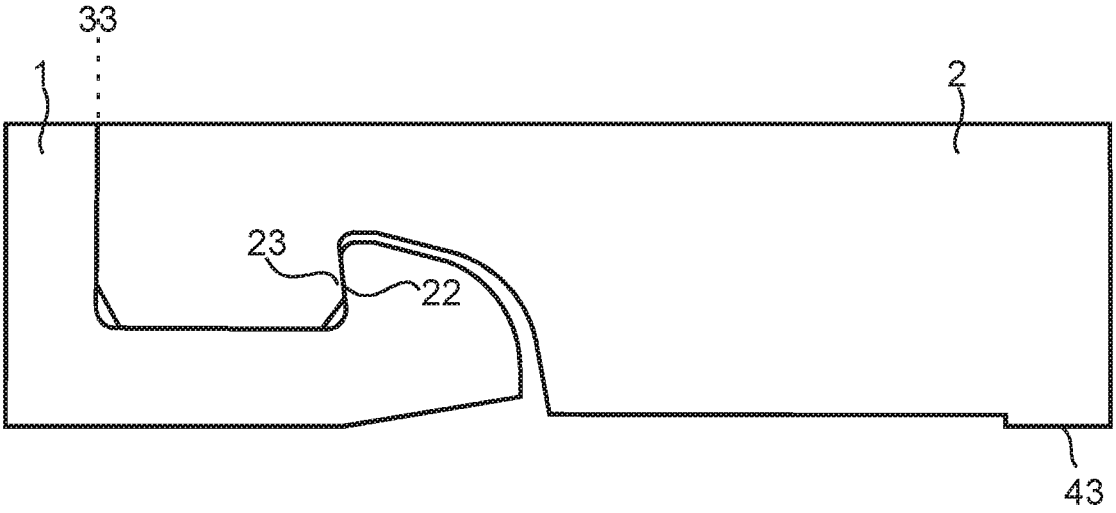

FIG. 5A-B shows an embodiment of the invention comprising another embodiment of the mechanical locking system at a first panel 1 and a second panel 2 during an assembling. The mechanical locking system comprises a locking element 8 at the first edge of the first panel 1. The locking element 8 is configured to cooperate with a locking groove 7 at the second edge of the second panel 2 for locking the first edge to the second edge in the second direction D2. The locking element 8 is preferably arranged on a locking strip 6 protruding from the first edge and the locking groove 7 is at a lower surface 43 of the second panel. An inner edge of the locking element 8 comprising a tongue 30 configured to cooperate with a tongue groove 10 at an inner edge of the locking groove 7 for locking the first edge to the second edge in the first direction D1. An upper edge of the tongue 30 at the locking element 8 comprising a first guiding surface 20 and a lower surface of a lower lip of the tongue groove 10 at the looking groove 7 comprises a second guiding surface 21. An upper most edge of the first panel and an upper most edge of the second panel may be in contact at a joint plane 33. The tongue and the tongue groove are preferably formed of a core material of the first panel 1 and the second panel 2, respectively. The first panel and the second panel are, during the assembling, displaced vertically relative each other in the first direction D1, as shown in FIG. 5A, such that the first guiding surface 20 and the second guiding surface 21 cooperate with each other. The first panel and the second panel are shown in a locked position in FIG. 5B. A first locking surface 22 of the tongue and a second locking surface 23 of the tongue groove cooperate with each other in the locked position.

Figure 6A:
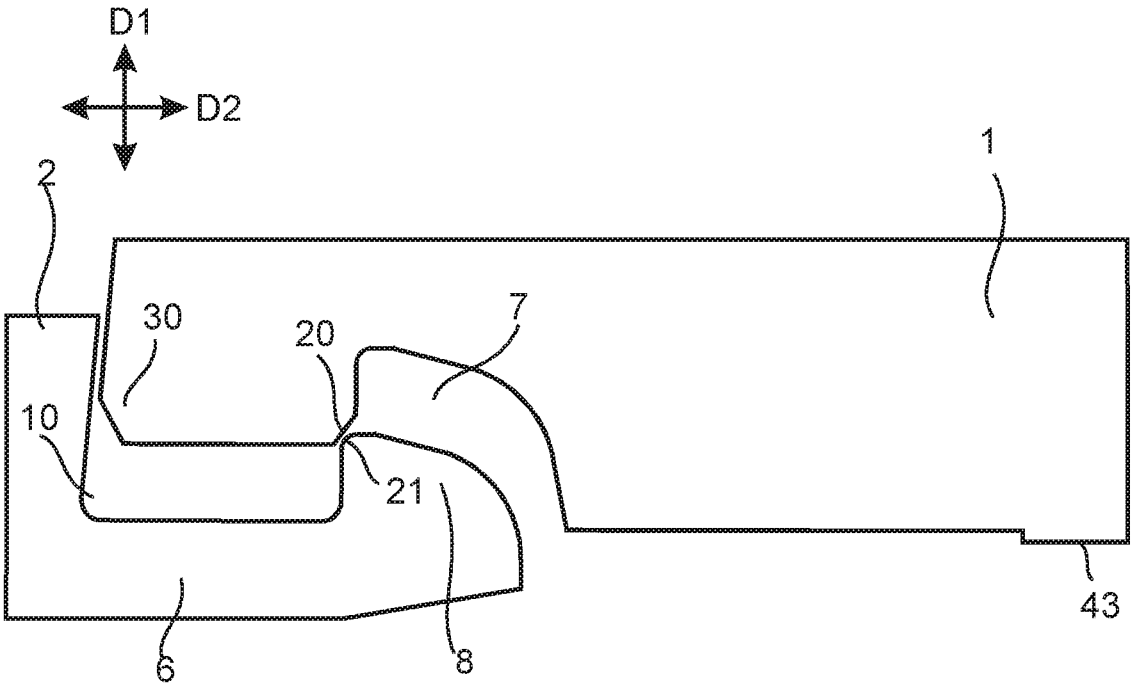
FIGS. 6A-6B show a first panel and a second panel according to an embodiment of the invention during an assembling.
Figure 6B:
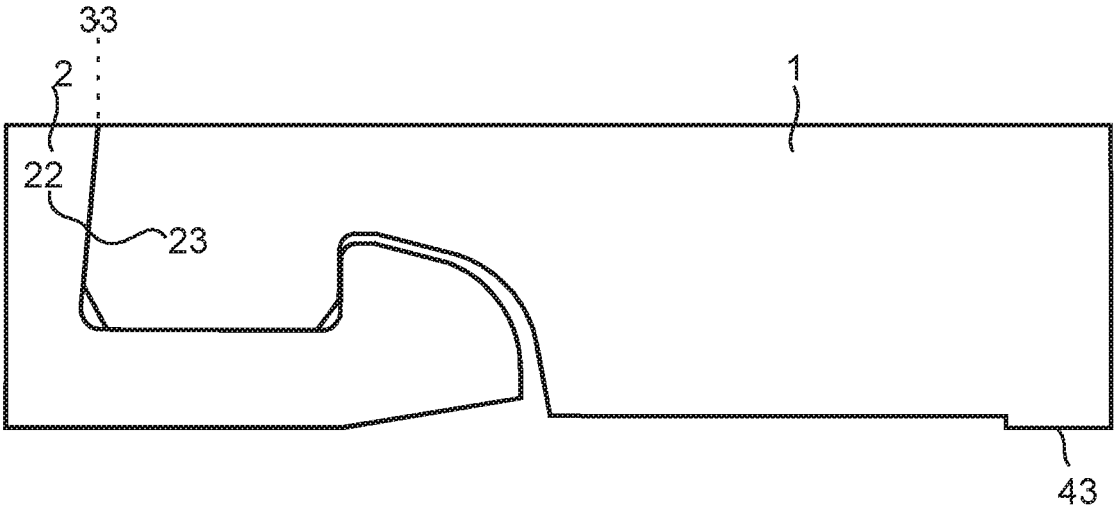

FIG. 6A-B shows an embodiment of the invention comprising another embodiment of the mechanical locking system at a first panel 1 and a second panel 2 during an assembling. The mechanical locking system comprises a locking element 8 at the second edge of the second panel 2. The locking element is configured to cooperate with a locking groove 7 at the first edge of the first panel 2 for locking the first edge to the second edge in the second direction D2. The locking element 8 is preferably arranged on a locking strip 6 protruding from the second edge and the locking groove 7 is at a lower surface 43 of first panel. An upper edge of the locking element 8 comprising a second guiding surface 21 and a lower a lower edge at the opening of the looking groove 7 comprises a first guiding surface 20. An upper most edge of the first panel and an upper most edge of the second panel may be in contact at a joint plane 33. The first edge comprises a tongue 30 at the joint plane and the second edge comprises a tongue groove 10 at the joint plane. The tongue and the tongue groove at the joint plane are configured to cooperate for locking the first edge to the second edge in the first direction D1. The tongue and the tongue groove are preferably formed of a core material of the first panel 1 and the second panel 2, respectively. The first panel and the second panel are, during the assembling, displaced vertically relative each other in the first direction D1, as shown in FIG. 6A, such that the first guiding surface 20 and the second guiding surface 21 cooperate with each other. The first panel and the second panel are shown in a locked position in FIG. 6B. A first locking surface 22 of the tongue and a second locking surface 23 of the tongue groove cooperate with each other in the locked position.

The first and the second panels may comprise a core material comprising a polymer material.

The polymer material may be one or more of the materials:

Vinyls, such as polyvinyl chloride and polyvinyl butyral;
Polyolefins, such as PE and PP;
Polyesters, including polyethylene terephthalate (PET);
Styrenics, such as polystyrene;
Acrylics, such as PMMA;
co-polymers, such as co-polymers including one or more of the above materials; and
polymer blends, such as polymer blends including one or more of the above materials.

The core material may comprise a filler and/or a reinforcement material.

The reinforcement material may be arranged as a reinforcement layer 40 extending essentially parallel to an upper surface 42 of the first and the second panel, respectively. Said reinforcement layer may increase the friction and may therefore be arranged such that an outer edge of the reinforcement layer is preferably at a non-guiding surface, such as a bottom surface of the tongue groove.

The filler material may be one or more of wood fibre, preferably as dust, or chalk.

The reinforcement material may be one or more of calcium silicate, e.g., wollastonite, or glass fiber.

A method for producing an embodiment of a mechanical locking system for a first panel and a second panel, such as building panels or floor panels, comprises:

providing a tongue 30, comprising a first locking surface 22, at a first edge of the first panel 1,
forming a tongue groove 10, comprising a second locking surface 23, preferably by mechanical cutting, at a second edge of the second panel, said first and second locking surface are configured to cooperate for locking the first edge to the second edge in a first direction D1,
providing a first guiding surface 20 at the first edge and a second guiding surface 21 at the second edge, wherein the mechanical locking system is configured such that first guiding surface cooperates with the second guiding surface during an assembling of the first edge and the second edge
working of the first and/or the second guiding surface to reduce the coefficient of friction.

The first and/or the second guiding surface of the above described mechanical locking system preferably has a lower coefficient of friction and/or a finer surface roughness than an adjacent surface in the locking system. For example, an adjacent surface produced by the same or similar process step, such as mechanical cutting.

The mechanical locking system may be produced by mechanical cutting, such as milling, preferably in a milling line. Said working of the first guiding surface and/or the second guiding surface to reduce the coefficient of friction a surface roughness may be made in the milling line. The mechanical cutting may result in a guiding surface with a high friction coefficient and/or a coarse surface roughness.

Figure 7A:
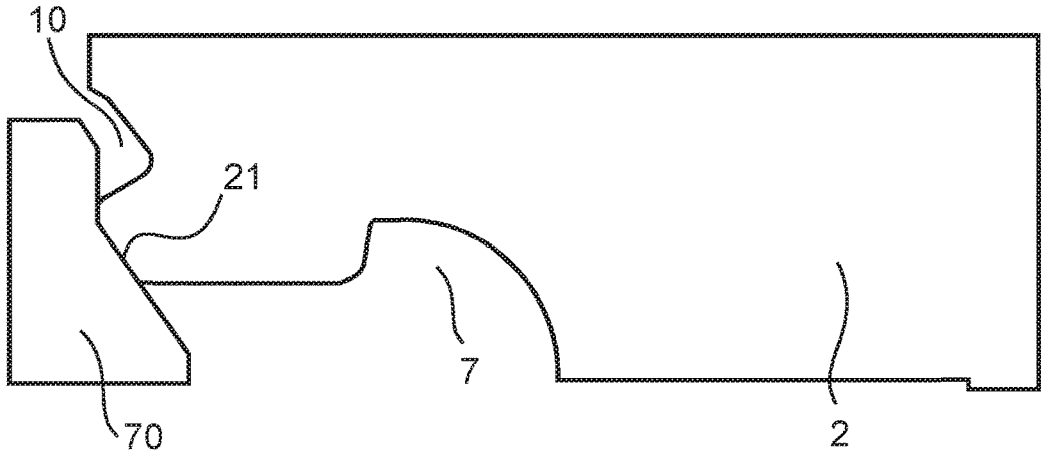
FIGS. 7A-7C show tools and methods according to embodiments of the invention for producing embodiments of the first guiding surface.
Figure 7B:
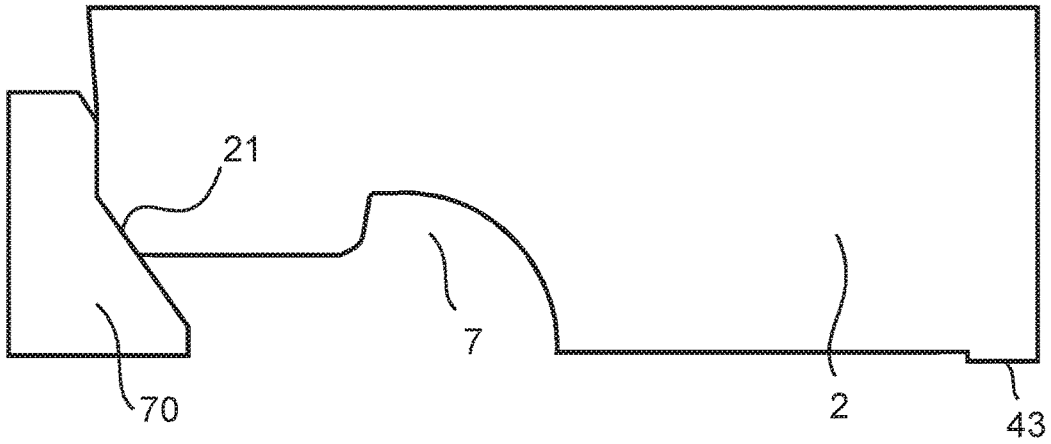
Figure 7C:
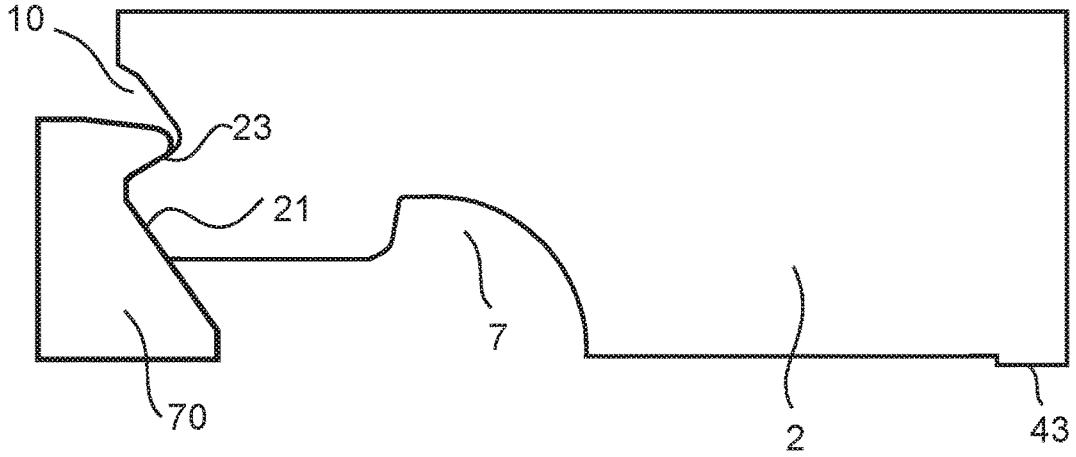

FIG. 7A-7C shows embodiment of the working of the second guiding surface 21 by a tool 70. The working of the second guiding surface may be a polishing, a sanding, a grinding, and/or a pressing by, e.g., a fixed tool, such as a sliding bar or pressure shoe The fixed tool may for example reduce the surface roughness of the second guiding surface within the range of about 30% to about 50%, or about 30% to about 40%. The surface roughness value may be decreased from about 3 Ra to about 2 Ra. For example, the surface roughness may be decreased at least 0.5 Ra, such as at least 0.8 Ra, such as at least 1 Ra. For example, the surface roughness may be decreased to a value of less than about 2.5 Ra, such as less than 2.2 Ra, such as less than 2 Ra. Such a decrease of surface roughness may result in a considerable reduction of the coefficient of friction. This may have the effect that the assembling of first panel and the second panel changes from being difficult to easy, or for some embodiments from being impossible to easy.

The surface roughness may be measured with a diamond stylus profilometer, such as E-35B from Accretech.

An embodiment may comprise a core comprising a wood based material, such as MDF or MDF. The surface roughness value for this embodiment may be decreased from about 5 Ra to about 3 Ra. For example, the surface roughness may be decreased at least 1 Ra, such as at least 1.5 Ra, such as at least 2 Ra. For example, the surface roughness may be decreased to a value of less than about 4 Ra, such as less than 3.5 Ra, such as less than 3 Ra. The working of the first guiding surface and/or the second guiding surface of this embodiment preferably reduces the surface roughness within the range of about 30% to about 50%, or about 30% to about 40%.

The method and the tool for working the first guiding surface may work the second guiding surface and an adjacent surface which may also be a guiding surface, as shown in the FIGS. 7A-7C. The tool may also have a shape configured such that only the second guiding surface is being worked (not shown). FIG. 7A shows an embodiment comprising working of the second guiding surface after the tongue groove 10 is formed. FIG. 7B shows a preferred embodiment comprising working of the second guiding surface before the tongue groove is formed. FIG. 7C shows an embodiment comprising working of the second guiding surface 21 and the second locking surface 23, at the same time and with an embodiment of the tool 70.

The method and the tool for working the first guiding surface, the third guiding surface or the fourth guiding surface (not shown) may be the same or similar with a shape that is adapted to the first guiding surface, the third guiding surface and the fourth guiding surface, respectively.

The fixed tool may be of metal, such as steel, and preferably comprises a surface of hard metal or diamond.

The method may comprise forming an insertion groove 20, preferably by mechanical cutting, at the first edge and arranging the tongue 30, preferably a displaceable tongue, in the insertion groove 20 by an inserting machine preferably arranged in the milling line.

The method may comprise forming the tongue, preferably by mechanical cutting in the milling line, at the first edge.

The method may comprise:

forming a locking element 8 at the first or the second edge, preferably by mechanical cutting in the milling line; and
forming a locking groove 7 at the other of the first or the second edge, preferably by mechanical cutting in the milling line, wherein the locking element is configured to cooperate with the locking groove for locking the first edge to the second edge in a second direction D2 which is perpendicular to the first direction D1.

The method may comprise forming, preferably in the milling line, the tongue at the locking element or the locking groove and the tongue groove at the other of the locking element or locking groove.

The method may comprise forming, preferably in the milling line, one or more of the tongue, the tongue groove, the locking element and the locking groove of a core material of the first and/or the second panel.

Any embodiment of the mechanical locking system described above may be produced by embodiments of the method described above.

Embodiments

1. A method for producing a mechanical locking system for a first panel and a second panel, such as building panels or floor panels, wherein the method comprises:

providing a tongue (30), comprising a first locking surface (22), at a first edge of the first panel (1);

forming a tongue groove (10), comprising a second locking surface (23), preferably by mechanical cutting, at a second edge of the second panel, said first locking surface and second locking surface are configured to cooperate for locking the first edge to the second edge in a first direction (D1);

providing a first guiding surface (20) at the first edge and a second guiding surface (21) at the second edge, wherein the mechanical locking system is configured such that first guiding surface cooperates with the second guiding surface during an assembling of the first edge and the second edge; and working of the first guiding surface and/or the second guiding surface to reduce a coefficient of friction between the first guiding surface and the second guiding surface and/or to reduce a surface roughness of the worked guiding surface(s).

2. The method as in embodiment 1, comprising working the second guiding surface, wherein the method for forming the second locking surface (23) is different from the method for working of the second guiding surface (21).

3. The method as in embodiment 1 or 2, comprising working the first guiding surface, wherein a method for forming the first locking surface (23) is different from the method for working of the first guiding surface (20).

4. The method as in any one of the embodiments 1-3, wherein the working of the first guiding surface and/or the second guiding surface is a polishing, a sanding, a grinding and/or pressing by, e.g., a fixed tool, such as a sliding bar or pressure shoe.

5. The method as in any one of the embodiments 1-5, wherein the first panel and the second panels comprises a core material comprising a polymer material, such as a thermoplastic material.

6. The method as in embodiment 5, wherein the core material comprises a filler and/or a reinforcement material.

7. The method as in any one of the embodiments 1-6, wherein the working of the guiding surface is made before the forming of the tongue groove.

8. The method as in any one of the embodiments 1-7, wherein the method comprises forming an insertion groove (31), preferably by mechanical cutting, at the first edge and arranging the tongue (30), preferably a displaceable tongue, in the insertion groove (20).

9. The method as in any one of the embodiments 1-7, wherein the method comprises forming the tongue, preferably by mechanical cutting, at the first edge.

10. The method as in any one of the preceding embodiments, wherein the method comprises:

forming a locking element (8) at the first edge or the second edge, preferably by mechanical cutting; and forming a locking groove (7) at the other of the first edge or the second edge, preferably by mechanical cutting, wherein the locking element is configured to cooperate with the locking groove for locking the first edge to the second edge in a second direction (D2) which is perpendicular to the first direction (D1).

11. The method as in embodiment 10, wherein the tongue is formed at the locking element or the locking groove and the tongue groove is formed at the other of the locking element or locking groove.

12. The method as in any one of the preceding embodiments, wherein one or more of the tongue, the tongue groove, the locking element and the locking groove are formed of a core material of the first and or the second panel.

13. The method as in any one of the preceding embodiments, wherein the working of the first guiding surface and/or the second guiding surface reduces the surface roughness value within the range of about 30% to about 50%, or from about 30% to about 40%.

14. The method as in any one of the preceding embodiments, wherein the working of the first guiding surface and/or the second guiding surface reduces the surface roughness to a value of less than about 2.5 Ra, such as less than 2.2 Ra, such as less than 2 Ra.

15. The method as in any one of the preceding embodiments, wherein the working of the first guiding surface and/or the second guiding surface decreases the surface roughness value at least 0.5 Ra, such as at least 0.8 Ra, such as at least 1 Ra.

16. The method as in any one of the preceding embodiments, wherein the working of the first guiding surface and/or the second guiding surface reduces the surface roughness value from about 3 Ra to about 2 Ra.

The invention claimed is:

1. A method for producing a mechanical locking system for a first panel and a second panel, wherein the first and second panels comprise a core material comprising a thermoplastic material, wherein the method comprises:

providing a tongue, comprising a first locking surface, at a first edge of the first panel;

forming a tongue groove, comprising a second locking surface, at a second edge of the second panel, said first locking surface and second locking surface are configured to cooperate for locking the first edge to the second edge in a first direction;

providing a first guiding surface at the first edge and a second guiding surface at the second edge, wherein the mechanical locking system is configured such that first guiding surface cooperates with the second guiding surface during an assembling of the first edge and the second edge; and working of the first guiding surface and/or the second guiding surface, to reduce a surface roughness of the worked guiding surface(s), wherein the working is performed by a fixed tool; and working, with the fixed tool, of an adjacent surface which is adjacent to the second guiding surface, while working the first guiding surface and/or the second guiding surface with the fixed tool.

2. The method as claimed in claim 1, comprising working the second guiding surface, wherein the method for forming the second locking surface is different from the method for working of the second guiding surface.

3. The method as claimed in claim 1, comprising working the first guiding surface, wherein a method for forming the first locking surface is different from the method for working of the first guiding surface.

4. The method as claimed in claim 1, wherein the working of the first guiding surface and/or the second guiding surface is a polishing, a sanding, a grinding and/or a pressing.

5. The method as claimed in claim 1, wherein the core material comprises a filler and/or a reinforcement material.

6. The method as claimed in claim 1, wherein the working of the first guiding surface or the second guiding surface is made before the forming of the tongue groove.

7. The method as claimed in claim 1, wherein the method comprises forming an insertion groove, at the first edge and arranging the tongue, in the insertion groove.

8. The method as claimed in claim 1, wherein the method comprises forming the tongue, at the first edge.

9. The method as claimed in claim 1, wherein one or more of the tongue, the tongue groove, the locking element and the locking groove are formed of a core material of the first and or the second panel.

10. The method as claimed in claim 1, wherein the working of the first guiding surface and/or the second guiding surface reduces the surface roughness value within the range of about 30% to about 50%.

11. The method as claimed in claim 1, wherein the working of the first guiding surface and/or the second guiding surface reduces the surface roughness to a value of less than about 2.5 Ra.

12. The method as claimed in claim 1, wherein the working of the first guiding surface and/or the second guiding surface decreases the surface roughness value at least 0.5 Ra.

13. The method as claimed in claim 1, wherein the working of the first guiding surface and/or the second guiding surface reduces the surface roughness value from about 3 Ra to about 2 Ra.

14. The method as claimed in claim 1, wherein the first and second panels are building panels or floor panels.

15. The method as claimed in claim 1, wherein the fixed tool is a sliding bar or a pressure shoe.

16. The method as claimed in claim 1, wherein the working of the first guiding surface and/or the second guiding surface is a sanding, a grinding and/or a pressing.

17. The method as claimed in claim 1, wherein the adjacent surface is at a non-zero angle relative to the second guiding surface.

18. The method as claimed in claim 1, wherein the method comprises:

forming a locking element at the first edge or the second edge; and forming a locking groove at the other of the first edge or the second edge, wherein the locking element is configured to cooperate with the locking groove for locking the first edge to the second edge in a second direction which is perpendicular to the first direction.

19. The method as claimed in claim 18, wherein the tongue is formed at the locking element or the locking groove and the tongue groove is formed at the other of the locking element or locking groove.

20. The method as claimed in claim 1, wherein the fixed tool works the second guiding surface and the adjacent surface at the same time.

21. The method as claimed in claim 20, wherein the adjacent surface is at a non-zero angle relative to the second guiding surface.

* * * * *